US011392074B2

(12) United States Patent
Ishida et al.

(10) Patent No.: US 11,392,074 B2
(45) Date of Patent: Jul. 19, 2022

(54) ELECTROPHOTOGRAPHIC PHOTOSENSITIVE MEMBER HAVING OUTER SURFACE WITH FIRST AND SECOND STRUCTURE GROUPS, THE FIRST STRUCTURE GROUP HAVING A SMALLER APPEARANCE PERIOD AND A LOWER HEIGHT THAN THE SECOND STRUCTURE GROUP

(71) Applicant: CANON KABUSHIKI KAISHA, Tokyo (JP)

(72) Inventors: Tomohito Ishida, Shizuoka (JP); Nobuhiro Nakamura, Shizuoka (JP); Shuhei Iwasaki, Kanagawa (JP); Hiroyuki Watanabe, Shizuoka (JP); Tatsuya Yamaai, Kanagawa (JP); Yuka Ishiduka, Shizuoka (JP); Yota Ito, Tokyo (JP); Takeshi Murakami, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/228,879

(22) Filed: Apr. 13, 2021

(65) Prior Publication Data

US 2021/0325814 A1 Oct. 21, 2021

(30) Foreign Application Priority Data

Apr. 21, 2020 (JP) ..... JP2020-075648

(51) Int. Cl.
*G03G 21/00* (2006.01)

(52) U.S. Cl.
CPC ..... *G03G 21/0005* (2013.01); *G03G 2215/00962* (2013.01); *G03G 2221/0026* (2013.01); *G03G 2221/1606* (2013.01)

(58) Field of Classification Search
CPC ..... G03G 15/751; G03G 21/0005; G03G 2215/00962; G03G 2221/0026; G03G 2221/1606
See application file for complete search history.

(56) References Cited

U.S. PATENT DOCUMENTS 4,804,607 A 2/1989 Atsumi
4,908,329 A 3/1990 Kanai et al.
(Continued)

FOREIGN PATENT DOCUMENTS

JP 2006-11047 A 1/2006
JP 2010-250355 A 11/2010
(Continued)

OTHER PUBLICATIONS

U.S. Appl. No. 17/229,475, Nobuhiro Nakamura, filed Apr. 13, 2021.
U.S. Appl. No. 17/230,550, Shuhei Iwasaki, filed Apr. 14, 2021.

*Primary Examiner* — Joseph S Wong
(74) *Attorney, Agent, or Firm* — Venable LLP

(57) ABSTRACT

Provided is an electrophotographic photosensitive drum that achieves both of a reduction in torque of the electrophotographic photosensitive drum at the time of its cleaning and an improvement in image transferability. The electrophotographic photosensitive drum includes: a support; and a photosensitive layer arranged on the support, the electrophotographic photosensitive drum having arranged on an outer surface thereof at least two structure groups having different appearance periods, wherein when, out of the two structure groups, a group including structures having a smaller appearance period is defined as a first structure group, and a group including structures having a larger appearance period is defined as a second structure group, a height of the first structure group is lower than a height of the second structure group.

7 Claims, 10 Drawing Sheets

(56) References Cited

U.S. PATENT DOCUMENTS

| | | | |
|---|---|---|---|
| 4,908,330 | A | 3/1990 | Arai et al. |
| 5,759,291 | A | 6/1998 | Ichinose et al. |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,266,329 | B2 | 9/2007 | Matsuo et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,841,052 | B2 | 9/2014 | Watariguchi et al. |
| 8,865,381 | B2 | 10/2014 | Tanaka et al. |
| 8,974,991 | B2 | 3/2015 | Kawahara et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,068,083 | B2 | 6/2015 | Tanaka et al. |
| 9,069,267 | B2 | 6/2015 | Kaku et al. |
| 9,256,145 | B2 | 2/2016 | Fujii et al. |
| 9,280,071 | B2 | 3/2016 | Maruyama et al. |
| 9,304,416 | B2 | 4/2016 | Noguchi et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,405,206 | B2 | 8/2016 | Kawaguchi et al. |
| 9,436,107 | B2 | 9/2016 | Murakami et al. |
| 9,459,542 | B2 | 10/2016 | Tanaka et al. |
| 9,523,929 | B2 | 12/2016 | Nakamura et al. |
| 9,535,346 | B2 | 1/2017 | Sekiya et al. |
| 9,535,347 | B2 | 1/2017 | Watariguchi et al. |
| 9,599,915 | B2 | 3/2017 | Anezaki et al. |
| 9,599,917 | B2 | 3/2017 | Okuda et al. |
| 9,658,543 | B2 | 5/2017 | Murakami et al. |
| 9,684,277 | B2 | 6/2017 | Yamamoto et al. |
| 9,726,992 | B2 | 8/2017 | Sakuma et al. |
| 9,772,569 | B2 | 9/2017 | Tanaka et al. |
| 9,851,646 | B2 | 12/2017 | Tomono et al. |
| 10,018,928 | B2 | 7/2018 | Murakami et al. |
| 10,073,362 | B2 | 9/2018 | Fujii et al. |
| 10,095,137 | B2 | 10/2018 | Murakami et al. |
| 10,372,050 | B2 | 8/2019 | Nishi et al. |
| 10,416,581 | B2 | 9/2019 | Ito et al. |
| 10,452,021 | B2 | 10/2019 | Miura et al. |
| 10,539,892 | B2 | 1/2020 | Nishida et al. |
| 10,545,453 | B2 | 1/2020 | Iwasaki et al. |
| 10,558,132 | B2 | 2/2020 | Ishiduka et al. |
| 10,558,133 | B2 | 2/2020 | Nakamura et al. |
| 10,642,177 | B2 | 5/2020 | Nakamura et al. |
| 10,663,913 | B2 * | 5/2020 | Yamaai ..... G03G 5/06149 |
| 10,691,033 | B2 | 6/2020 | Nishida et al. |
| 10,747,130 | B2 | 8/2020 | Okuda et al. |
| 10,747,131 | B2 | 8/2020 | Watanabe et al. |
| 10,831,117 | B2 | 11/2020 | Sakakibara et al. |
| 10,831,118 | B2 | 11/2020 | Watanabe et al. |
| 10,838,315 | B2 | 11/2020 | Shimozawa et al. |
| 10,942,462 | B2 | 3/2021 | Ito et al. |
| 11,003,102 | B2 | 5/2021 | Ishiduka et al. |
| 2005/0069351 | A1 | 3/2005 | Matsuo |
| 2010/0119260 | A1 | 5/2010 | Egawa |
| 2014/0004450 | A1 | 1/2014 | Tokimitsu et al. |
| 2015/0185630 | A1 | 7/2015 | Ito et al. |
| 2015/0185634 | A1 | 7/2015 | Sekiya et al. |
| 2015/0241799 | A1 * | 8/2015 | Takahashi ..... G03G 5/147 399/111 |
| 2017/0060008 | A1 | 3/2017 | Okuda et al. |
| 2018/0321612 | A1 * | 11/2018 | Sakamaki ..... G03G 15/50 |
| 2020/0159135 | A1 * | 5/2020 | Ichihashi ..... G03G 15/751 |
| 2020/0264526 | A1 | 8/2020 | Shimozawa et al. |
| 2020/0393771 | A1 | 12/2020 | Iwasaki et al. |
| 2020/0409278 | A1 | 12/2020 | Makisumi et al. |
| 2020/0409279 | A1 | 12/2020 | Sekiya et al. |
| 2020/0409280 | A1 | 12/2020 | Ishida et al. |
| 2020/0409281 | A1 | 12/2020 | Watariguchi et al. |
| 2021/0026260 | A1 | 1/2021 | Noguchi et al. |
| 2021/0026268 | A1 | 1/2021 | Murakami et al. |
| 2021/0116826 | A1 | 4/2021 | Nishida et al. |
| 2021/0116833 | A1 | 4/2021 | Ishiduka et al. |

FOREIGN PATENT DOCUMENTS

| | | | |
|---|---|---|---|
| JP | 2015-161786 | A | 9/2015 |
| JP | 2017-181926 | A | 10/2017 |
| JP | 2010-026240 | A | 2/2020 |

* cited by examiner

ELECTROPHOTOGRAPHIC PHOTOSENSITIVE MEMBER HAVING OUTER SURFACE WITH FIRST AND SECOND STRUCTURE GROUPS, THE FIRST STRUCTURE GROUP HAVING A SMALLER APPEARANCE PERIOD AND A LOWER HEIGHT THAN THE SECOND STRUCTURE GROUP

BACKGROUND OF THE INVENTION

Field of the Invention

The present disclosure relates to an electrophotographic photosensitive member having drum shape, and a process cartridge and an electrophotographic image forming apparatus each including the electrophotographic photosensitive member.

Description of the Related Art

Various electrical external forces and mechanical external forces are applied to the surface of an electrophotographic photosensitive member (hereinafter sometimes simply referred to as "photosensitive member") to be used in an electrophotographic image forming apparatus (hereinafter sometimes simply referred to as "electrophotographic apparatus") by repeating, for example, a charging step, an exposing step, a developing step, a transferring step, and a cleaning step. Of those, a frictional force occurring between the surface of the electrophotographic photosensitive member and a cleaning blade in the cleaning step is large, and affects the distortion of an image due to the abrasion of the surface of the electrophotographic photosensitive member or a cleaning failure.

To alleviate the abrasion of the surface of the electrophotographic photosensitive member, the improvement of a material for the surface layer thereof has been advanced, and an improvement technology including improving the abrasion resistance thereof through use of a material excellent in abrasion resistance, such as a curable resin, in the surface layer has heretofore been investigated.

Meanwhile, to improve the abrasion resistance, the following improvement has been performed. Unevenness is formed on the surface of the electrophotographic photosensitive member to reduce the area of contact between the surface and the cleaning blade, thereby reducing the frictional force. When the frictional force occurring between the surface of the electrophotographic photosensitive member and the cleaning blade is reduced, the abrasion of the surface of the electrophotographic photosensitive member is suppressed, and the chattering and turning of the cleaning blade hardly occur. In addition, the torque of the electrophotographic photosensitive member at the time of its cleaning can be reduced.

In Japanese Patent Application Laid-Open No. 2006-11047, there is a disclosure of an electrophotographic photosensitive member having a linear flaw intersecting its surface for the purpose of achieving an improvement in cleaning property and the lengthening of the lifetime of the electrophotographic photosensitive member.

In Japanese Patent Application Laid-Open No. 2010-250355, there is a disclosure of a toner image-bearing member having a specific groove shape in its outer peripheral surface for the purpose of achieving both of high cleaning performance and the suppression of the entanglement of a cleaning blade.

In Japanese Patent Application Laid-Open No. 2015-161786, there is a disclosure of a surface processing method including transferring the uneven shape of a mold member onto the surface of an electrophotographic photosensitive member in which the stability of the uneven shape is high even under a high-temperature environment.

To adapt to various environments, a recent electrophotographic apparatus has been required to achieve a further reduction in torque and high transfer efficiency for a reduction in amount of waste toner.

However, in each of the technologies disclosed in Japanese Patent Application Laid-Open No. 2006-11047 and Japanese Patent Application Laid-Open No. 2010-250355, a reduction in torque of the electrophotographic photosensitive member resulting from a reduction in frictional force between the photosensitive member and the cleaning blade is observed, but residual toner escapes from a portion where the photosensitive member and the cleaning blade are brought into abutment with each other, and hence a sufficient effect on transfer efficiency has not been obtained.

In addition, the inventors have made extensive investigations, and as a result, have found that a structure for reducing the area of contact between the surface of the electrophotographic photosensitive member and the cleaning blade to reduce the torque of the photosensitive member, and a structure for reducing the area of contact between the surface and the toner to improve image transferability are different from each other in required appearance period. In addition, the inventors have found that when those structures are caused to act in a composite manner, both of a reduction in torque of the photosensitive member at the time of its cleaning and an improvement in image transferability can be achieved.

An object of the present disclosure is to provide an electrophotographic photosensitive member having drum shape (hereinafter sometimes simply referred to as "electrophotographic photosensitive drum" or "photosensitive drum") that achieves both of a reduction in torque of the electrophotographic photosensitive drum at the time of its cleaning and an improvement in image transferability.

SUMMARY OF THE INVENTION

The above-mentioned object is achieved by the present disclosure described below. That is, according to the present disclosure, there is provided an electrophotographic photosensitive member having drum shape, the electro photo graphic photo sensitive member comprising: a support; and a photosensitive layer arranged on the support, wherein the electrophotographic photosensitive drum comprises a first structure group and a second structure group which are constituted of structures having different appearance periods, on an outer surface thereof, an appearance period of the first structure group is smaller than an appearance period of the second structure group, and a height of the first structure group is lower than a height of the second structure group.

Further features of the present invention will become apparent from the following description of exemplary embodiments with reference to the attached drawings.

DESCRIPTION OF THE EMBODIMENTS

Figure 1A:
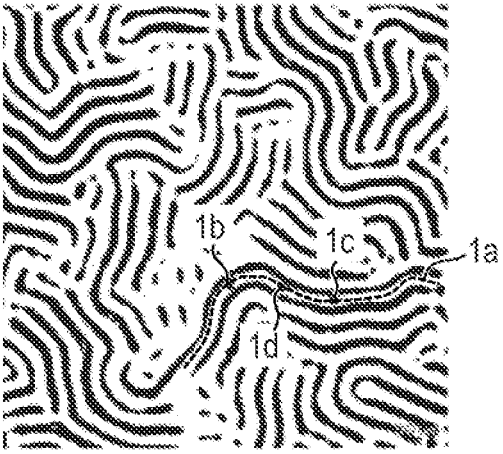
FIG. 1A and FIG. 1B are views for illustrating the concept of wrinkle shapes.

The present disclosure is described in detail below by taking an exemplary embodiment. The description "from ○○ to x x" representing a numerical range means a numerical range including a lower limit and an upper limit that are end points unless otherwise stated.

An electrophotographic photosensitive drum of the present disclosure is an electrophotographic photosensitive drum including a support and a photosensitive layer arranged on the support, and having arranged on the outer surface thereof at least two structure groups having different appearance periods, and achieves both of a reduction in torque at the time of the performance of its cleaning with a cleaning blade (hereinafter referred to as "at the time of its cleaning") and an improvement in image transferability by compositing a first structure group that includes structures having a smaller appearance period and has a low height, with a second structure group that includes structures having a larger appearance period and has a high height.

According to an investigation by the inventors, a reduction in area of contact between the cleaning blade and the outer surface of the electrophotographic photosensitive drum has been effective in reducing the torque of the photosensitive drum at the time of its cleaning. An efficient reduction in torque has been enabled by, for example, increasing the appearance period of convex shapes on the outer surface of the photosensitive drum to reduce the number of points of contact therebetween. However, when the appearance period of the convex portions is increased, there has been a tendency that the appearance period of concave portions is also inevitably increased, and the depths of the concave portions are increased. The inventors have found that under such surface state of the photosensitive drum, the torque reduces, but toner is liable to escape from the concave portions to cause a cleaning failure. In addition, when the appearance period is large, the toner has tended to enter the concave portions to deteriorate image transferability. According to an investigation by the inventors, an improvement in image transferability has been enabled by reducing the area of contact between the toner and the surface of the photosensitive drum to reduce an adhesive force therebetween. Thus, the inventors have found a structure having a smaller appearance period and a lower height as a shape contributing to an improvement in image transferability.

In view of the foregoing, the inventors have found that while an increase in appearance period of the convex portions for a reduction in area of contact between the cleaning blade and the surface of the photosensitive drum is effective in reducing the torque, convex shapes having a smaller appearance period are required for an improvement in image transferability.

In the related art, the surface of an electrophotographic photosensitive drum is formed of one certain kind of pattern, and hence it has been impossible to achieve both of a reduction in torque of the electrophotographic photosensitive drum at the time of its cleaning and an improvement in image transferability at a high level.

The present disclosure relates to the following electrophotographic photosensitive drum: the photosensitive drum has convex shapes on its outer surface, and a structure group that includes structures having a small appearance period and low convex portion heights, and a structure group that includes structures having a large appearance period and high convex portion heights are composited with each other to achieve both of a reduction in torque of the photosensitive drum at the time of its cleaning and an improvement in image transferability.

Further, when the structures are arranged in a row in the peripheral direction of the photosensitive drum, the toner may escape at the time of the cleaning. Accordingly, to maintain a satisfactory cleaning property, it is preferred that the structures be isotropically arranged.

When the at least two structure groups including the structures having different appearance periods are composited with each other like the foregoing mechanism, the respective structure groups synergistically affect each other to enable the achievement of both effects of the present disclosure, that is, a reduction in torque of the photosensitive drum at the time of its cleaning and an improvement in image transferability at a high level.

[ Structures of Outer Surface]

As described above, in one embodiment of the present disclosure, the electrophotographic photosensitive drum has, on its outer surface, the at least two structure groups including the structures having different appearance periods. In the two structure groups, a group including structures having a smaller appearance period is defined as a first structure group, and a group including structures having a larger appearance period is defined as a second structure group.

The respective features of the structures having the smaller appearance period (hereinafter also referred to as "first structures") and the structures having the larger appearance period (hereinafter also referred to as "second structures") are described below.

(1) First Structures

Any shape may be adopted as the shape of the first structures as long as the structures are of such a shape as to be periodically arranged on the outer surface of the photosensitive drum to the extent that the above-mentioned requirements are satisfied. For example, a shape having a certain repeating structure, such as a network shape, a lattice shape, or a dot, may be adopted, or a random shape like such a wrinkle shape as shown in FIG. 1A may be adopted. Herein, the phrase "periodically arranged" means that the first structures periodically appear in an arbitrary square region of the outer surface. The periodicity of the appearance may be obtained by, for example, measuring the height information on the first structures arranged on the outer surface of the electrophotographic photosensitive drum and analyzing the result of the measurement through use of two-dimensional Fourier transformation.

Herein, the term "arbitrary square region" as used herein is not meant to refer to a square region present at a specific position. In other words, it is not a sufficient requirement that the electrophotographic photosensitive drum according to the present disclosure satisfy the above-mentioned specifications at a certain specific position, and it is required that the above-mentioned specifications be satisfied irrespective of the position on the outer surface of the electrophotographic photosensitive drum at which the square region is placed.

When the height information is measured in an arbitrary square region, such as a square region 500 μm on a side, in a data number of N1×N2, a power spectrum P(k, l) obtained by discrete Fourier transformation is given by the equation (A).

$$P_{k,l} = \frac{1}{N_1 \cdot N_2} |f_{k,l}|^2 \quad \text{Equation (A)}$$

When, in the equation (A), a height at an arbitrary point (n, m) in the surface is represented by $h_{n,m}$, the equation (B) is derived:

$$f_{k,l} = \sum_{n=0}^{N_1-1} \sum_{m=0}^{N_2-1} h_{n,m} e^{-ikn} e^{-ilm} \quad \text{Equation (B)}$$

where "k" and "l" represent a frequency in a horizontal direction and a frequency in a vertical direction, respectively.

Figure 2A:
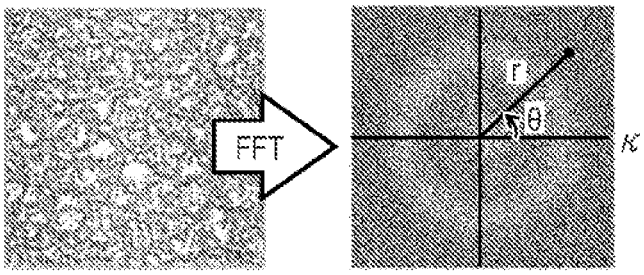
FIG. 2A, FIG. 2B, FIG. 2C, and FIG. 2D are views for illustrating wrinkle shapes.

Further, a power spectrum F(r, θ) obtained by converting the power spectrum P(k, l) represented by the equation (A) from an orthogonal coordinate system (k, l) to a polar coordinate system (r, θ) is shown in FIG. 2A where "r" and θ satisfy the equation (C) and the equation (D), respectively.

$$r=\sqrt{k^2+l^2} \quad \text{Equation (C)}$$

$$\theta=\mathrm{Tan}^{-1}(l/k) \quad \text{Equation (D)}$$

Figure 2B:
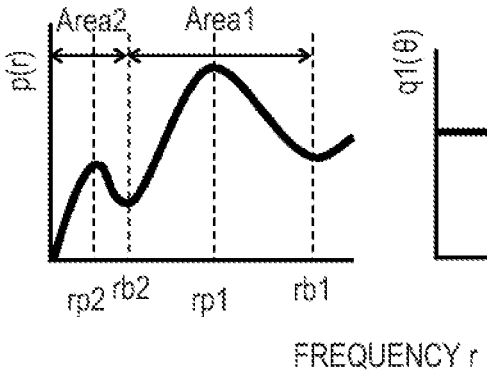

As a result of the analysis of the structure of the outer surface of the electrophotographic photosensitive drum for the power spectrum F(r, θ), as shown in FIG. 2B, a radial direction distribution function p(r) obtained by turning the power spectrum F(r, θ) into a one-dimension in the radial direction of the photosensitive drum has at least two frequencies rp at each of which the function becomes a local maximum. FIG. 2B shows that out of those, the frequency of the first structures having the smaller appearance period (higher frequency) is rp1, and the frequency of the second structures having the larger appearance period (lower frequency) is rp2.

Figure 2C:
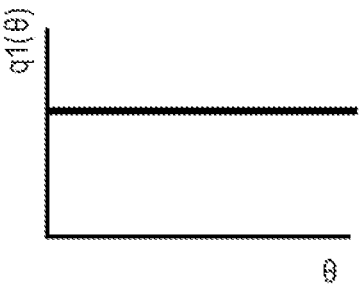

In addition, as shown in FIG. 2C, when the angle distribution q1(θ) of the power spectrum F(rp, θ) is calculated at the frequency rp1 at which the radial direction distribution function p(r) becomes a local maximum, variation in power value in the entire range of the θ is preferably 10% or less. A state in which the variation in power value is 10% or less means that the first structures are uniformly distributed in an arbitrary direction in the outer surface of the electrophotographic photosensitive drum, that is, the first structure group is isotropically arranged. A state in which the first structure group is isotropically arranged is preferred because the toner can be prevented from escaping at the time of the cleaning, and hence a cleaning property is improved.

According to an investigation by the inventors, the first structure group may contribute to an improvement in transferability. That is, the first structure group reduces the area of contact between the toner and the outer surface of the photosensitive drum to reduce an adhesive force therebetween, and hence the transferability of an electrostatic image formed on the photosensitive drum can be improved. The average particle diameter of the toner is typically from about 6 μm to about 8 μm, and hence the appearance period of the first structures is preferably from 1 μm to 5 μm, more preferably from 2.5 μm to 3.5 μm.

(2) Second Structures

As in the shape of the first structures, any shape may be adopted as the shape of the second structures as long as the structures are of such a shape as to be periodically arranged on the outer surface of the photosensitive drum to the extent that the above-mentioned requirements are satisfied. For example, a shape having a certain repeating structure, such as a network shape, a lattice shape, or a dot, may be adopted, or a random shape like a wrinkle shape may be adopted. The periodicity of the appearance of the second structures may be obtained by, as described above, measuring the height information on the second structures arranged on the outer surface of the electrophotographic photosensitive drum and analyzing the result of the measurement through use of two-dimensional Fourier transformation.

Figure 2D:
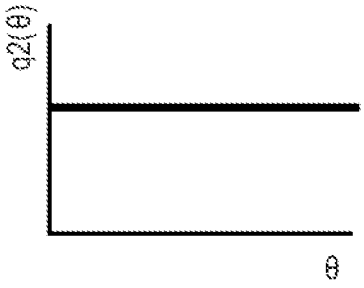

In addition, as shown in FIG. 2D, when the angle distribution q2(θ) of the power spectrum F(rp, θ) is calculated at the frequency rp2 at which the radial direction distribution function p(r) obtained by turning the power spectrum F(r, θ) into a one-dimension in the radial direction becomes a local maximum, variation in power value in the entire range of the θ is preferably 10% or less. A state in which the variation in power value is 10% or less means that the second structures are uniformly distributed in an arbitrary direction in the outer surface of the electrophotographic photosensitive drum, that is, the second structure group is isotropically arranged. A state in which the second structure group is isotropically arranged is preferred because the toner can be prevented from escaping at the time of the cleaning, and hence a cleaning property is improved.

According to an investigation by the inventors, the second structure group may contribute to a reduction in torque at the time of the cleaning. That is, the second structure group increases the period of the convex shapes on the outer surface of the photosensitive drum to reduce the number of points of contact between the cleaning blade and the outer surface. Thus, the area of contact between the cleaning blade and the outer surface of the photosensitive drum is reduced, and hence the torque at the time of the cleaning can be efficiently reduced. Accordingly, the appearance period of the second structures is preferably from 10 μm to 50 μm, more preferably from 20 μm to 30 μm.

(3) Height

As described above, to improve image transferability, the height of the first structure group needs to be lower than the height of the second structure group. In addition, the height of the first structure group and the height of the second structure group may be the average of the heights of the first structures and the average of the heights of the second structures, respectively.

As long as the height of the first structure group is lower than the height of the second structure group, the height of the first structure group and the height of the second structure group are not particularly limited. For example, the height of the first structure group is from 0.2 μm to 2.0 μm, preferably from 0.5 μm to 1.0 μm. In addition, for example, the height of the second structure group is from 0.5 μm to 5.0 μm, preferably from 1.0 μm to 2.0 μm.

Methods of determining the heights are described later.

[Electrophotographic Photosensitive Drum]

The electrophotographic photosensitive drum of the present disclosure is a cylindrical electrophotographic photosensitive member including the support and the photosensitive layer arranged on the support. The surface layer of the electrophotographic photosensitive drum contains a curable resin, and the photosensitive layer or a protective layer arranged on the photosensitive layer serves as the surface layer.

A method of producing the electrophotographic photosensitive drum is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective components are described.

<Support>

The support is preferably a conductive support having conductivity. In addition, the shape of the support is preferably cylindrical. In addition, the surface of the support may be subjected to, for example, electrochemical treatment, such as anodization, blast treatment, or cutting treatment.

A metal, a resin, glass, or the like is preferred as a material for the support.

Examples of the metal include aluminum, iron, nickel, copper, gold, stainless steel, and alloys thereof. Of those, an aluminum support using aluminum is preferred.

In addition, conductivity may be imparted to the resin or the glass through treatment involving, for example, mixing or coating the resin or the glass with a conductive material.

<Conductive Layer>

A conductive layer may be arranged on the support. The arrangement of the conductive layer can conceal a flaw and unevenness on the surface of the support, and can control the reflection of light on the surface of the support.

The conductive layer preferably contains conductive particles and a resin.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, the metal oxide is preferably used as the conductive particles. In particular, titanium oxide, tin oxide, or zinc oxide is more preferably used.

When the metal oxide is used as the conductive particles, the surface of the metal oxide may be treated with a silane coupling agent or the like, or the metal oxide may be doped with an element such as phosphorus or aluminum, or an oxide thereof.

In addition, the conductive particles may each be of a laminated configuration including a core particle and a covering layer covering the core particle. A material for the core particle is, for example, titanium oxide, barium sulfate, or zinc oxide. A material for the covering layer is, for example, a metal oxide, such as tin oxide.

In addition, when the metal oxide is used as the conductive particles, the volume-average particle diameter of the particles is preferably from 1 nm to 500 nm, more preferably from 3 nm to 400 nm.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain, for example, a concealing agent, such as a silicone oil, resin particles, or titanium oxide.

The average thickness of the conductive layer is preferably from 1 μm to 50 μm, particularly preferably from 3 μm to 40 μm.

The conductive layer may be formed by: preparing a coating liquid for a conductive layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent. A dispersion method for the dispersion of the conductive particles in the coating liquid for a conductive layer is, for example, a method including using a paint shaker, a sand mill, a ball mill, or a liquid collision-type high-speed dispersing machine.

<Undercoat Layer>

An undercoat layer may be arranged on the support or the conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting material, a metal oxide, a metal, a conductive polymer, and the like for the purpose of improving electric characteristics. Of those, an electron-transporting material and a metal oxide are preferably used.

Examples of the electron-transporting material include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting material having a polymerizable functional group may be used as the electron-transporting material and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably from 0.1 μm to more preferably from 0.2 μm to 40 μm, particularly preferably from 0.3 μm to 30 μm.

The undercoat layer may be formed by: preparing a coating liquid for an undercoat layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, an ester-based solvent, and an aromatic hydrocarbon-based solvent.

<Photosensitive Layer>

The photosensitive layer of the electrophotographic photosensitive drum is mainly classified into (1) a laminated photosensitive layer and (2) a single-layer photosensitive layer. (1) The laminated photosensitive layer includes a charge-generating layer containing a charge-generating material and a charge-transporting layer containing a charge-transporting material. (2) The single-layer photosensitive layer includes a photosensitive layer containing both of the charge-generating material and the charge-transporting material.

(1) Laminated Photosensitive Layer

The charge-generating layer and the charge-transporting layer in the laminated photosensitive layer are described below.

(1-1) Charge-Generating Layer

The charge-generating layer preferably contains the charge-generating material and a resin.

Examples of the charge-generating material include an azo pigment, a perylene pigment, a polycyclic quinone pigment, an indigo pigment, and a phthalocyanine pigment. Of those, an azo pigment and a phthalocyanine pigment are preferred. Of the phthalocyanine pigments, an oxytitanium phthalocyanine pigment, a chlorogallium phthalocyanine pigment, and a hydroxygallium phthalocyanine pigment are preferred.

The content of the charge-generating material in the charge-generating layer is preferably from 40 mass % to 85 mass %, more preferably from 60 mass % to 80 mass % with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably from 0.1 μm to 1 μm, more preferably from 0.15 μm to 0.4 μm.

The charge-generating layer may be formed by: preparing a coating liquid for a charge-generating layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting material and a resin.

Examples of the charge-transporting material include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred, and a compound represented by the formula (1) is suitably used.

(1)

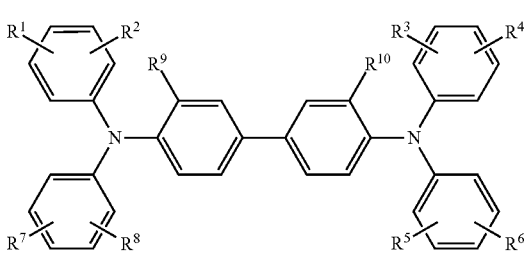

In the formula (1), $R^1$ to $R^{10}$ each independently represent a hydrogen atom or a methyl group.

Examples of the compound represented by the formula (1) are represented in the formula (1-1) to the formula (1-10). Of those, the compounds represented by the formula (1-1) to the formula (1-6) are more preferred.

(1-1)

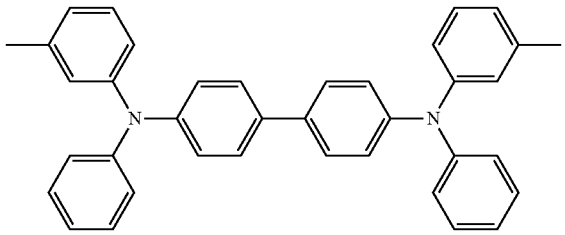

(1-2)

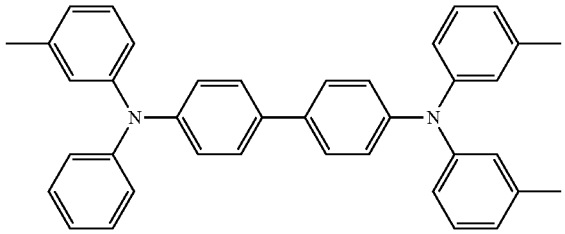

-continued (1-3)

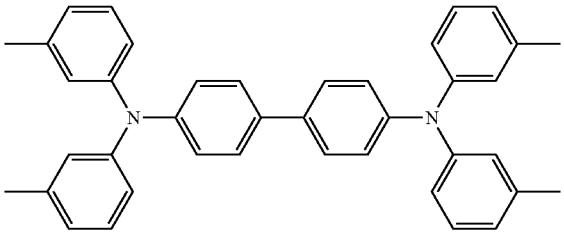

(1-4)

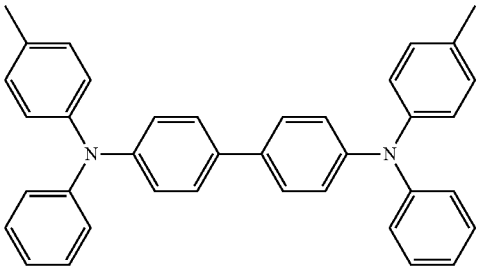

(1-5)

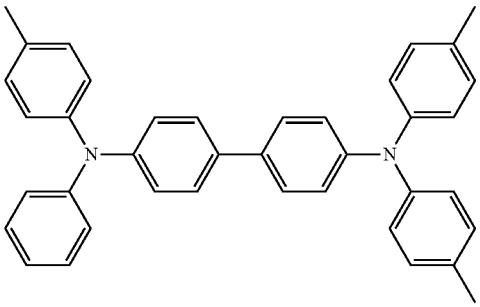

(1-6)

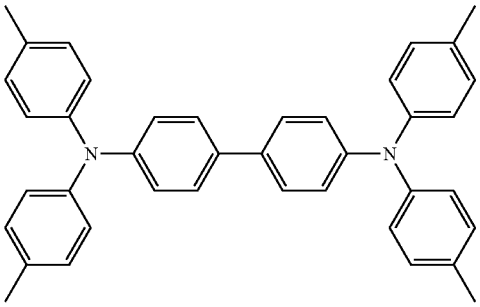

(1-7)

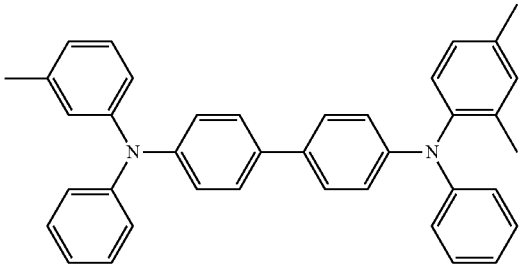

-continued (1-8)

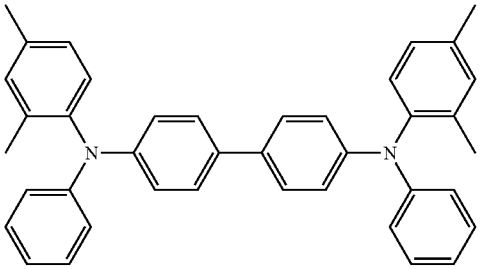

(1-9)

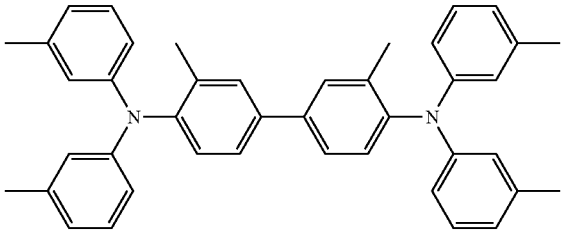

(1-10)

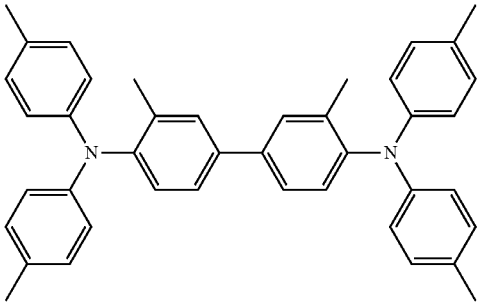

A thermoplastic resin is used as the resin, and examples thereof include a polyester resin, a polycarbonate resin, an acrylic resin, and a polystyrene resin. Of those, a polycarbonate resin and a polyester resin are preferred. As the polyester resin, a polyarylate resin is particularly preferred.

The content of the charge-transporting material in the charge-transporting layer is preferably from 25 mass % to 70 mass %, more preferably from 30 mass % to 55 mass % with respect to the total mass of the charge-transporting layer.

A content ratio (mass ratio) between the charge-transporting material and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge-transporting layer is preferably from 5 μm to 50 μm, more preferably from 8 μm to 40 μm, particularly preferably from 10 μm to 30 μm.

The charge-transporting layer may be formed by: preparing a coating liquid for a charge-transporting layer containing the above-mentioned respective materials and a solvent; forming a coating film of the coating liquid; and drying the coating film. Examples of the solvent to be used in the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by: preparing a coating liquid for a photosensitive layer containing the charge-generating material, the charge-transporting material, a resin, and a solvent; forming a coating film of the coating liquid; and drying the coating film. The charge-generating material, the charge-transporting material, and the resin are the same as the examples of the materials in the above-mentioned section "(1) Laminated Photosensitive Layer".

<Protective Layer>

A protective layer may be arranged on the photosensitive layer. The arrangement of the protective layer can improve the durability of the photosensitive drum.

The protective layer preferably contains conductive particles and/or the charge-transporting material, and a resin.

Examples of the conductive particles include metal oxide particles, such as titanium oxide, zinc oxide, tin oxide, and indium oxide.

Examples of the charge-transporting material include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred. In addition, the protective layer may be formed as a cured film by polymerizing a composition containing a monomer having a polymerizable functional group. A reaction at that time is, for example, a thermal polymerization reaction, a photopolymerization reaction, or a radiation polymerization reaction. Examples of the polymerizable functional group of the monomer having the polymerizable functional group include an acrylic group and a methacrylic group. A material having a charge-transporting ability may be used as the monomer having the polymerizable functional group.

A compound having a polymerizable functional group may have a charge-transportable structure as well as a chain-polymerizable functional group. The charge-transportable structure is preferably a triarylamine structure in terms of charge transportation. The chain-polymerizable functional group is preferably an acryloyl group or a methacryloyl group. The number of the polymerizable functional groups may be one, or may be two or more. A case in which the cured film is formed by incorporating a compound having a plurality of polymerizable functional groups and a compound having one polymerizable functional group out of such compounds is particularly preferred because distortion caused by the polymerization of the plurality of polymerizable functional groups is easily eliminated.

Examples of the compound having one polymerizable functional group are represented in the formula (2-1) to the formula (2-6).

(2-1)

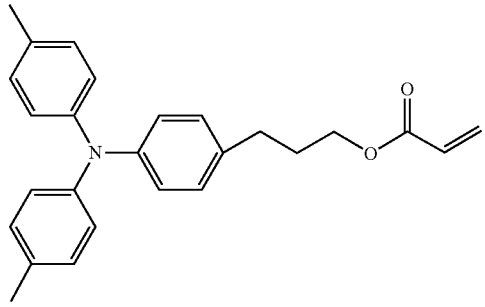

(2-2)

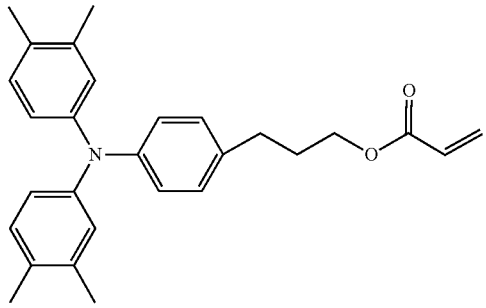

(2-3)

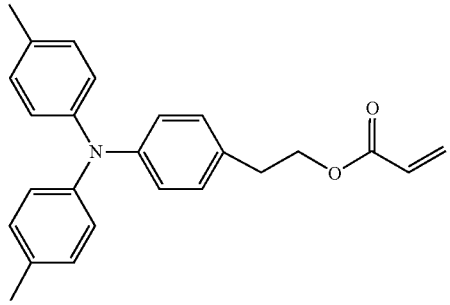

(2-4)

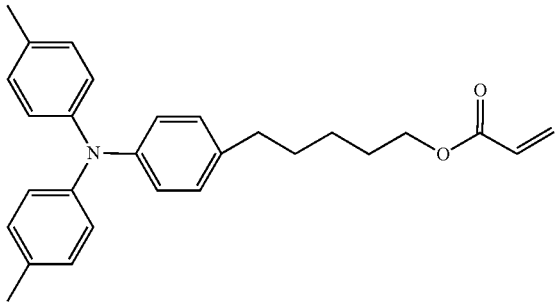

(2-5)

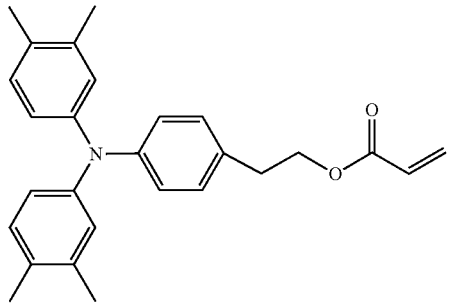

-continued
(2-6)
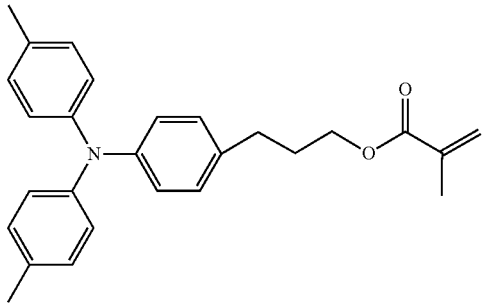
Examples of the compound having a plurality of polymerizable functional groups are represented in the formula (3-1) to the formula (3-7).
(3-1)
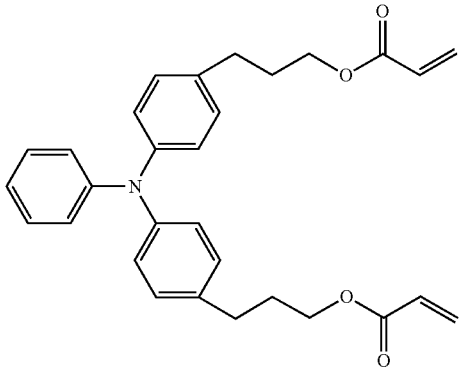
(3-2)
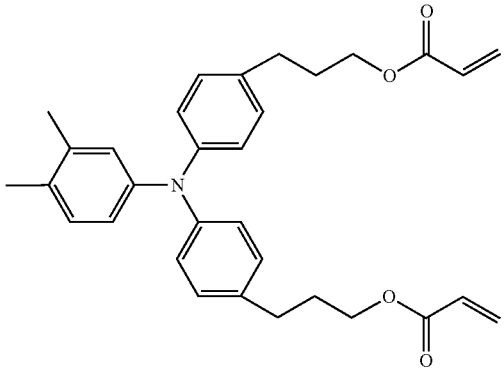
(3-3)
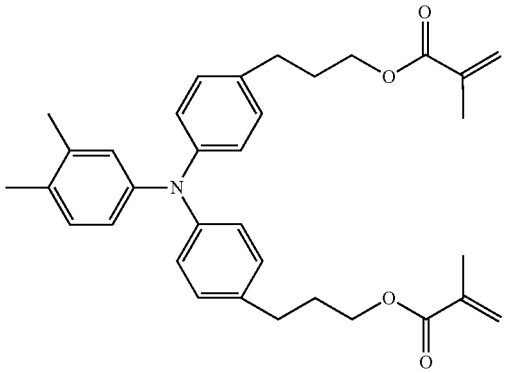
(3-4)
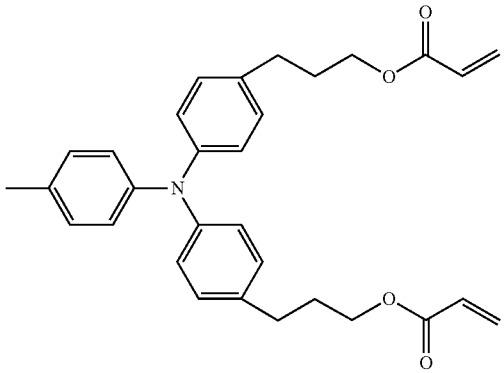
(3-5)
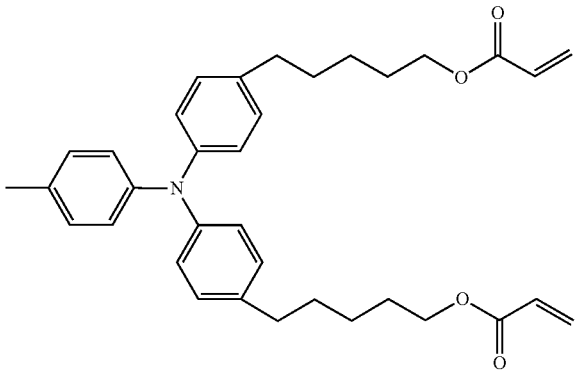
(3-6)
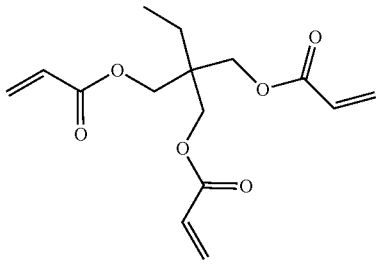

-continued (3-7)

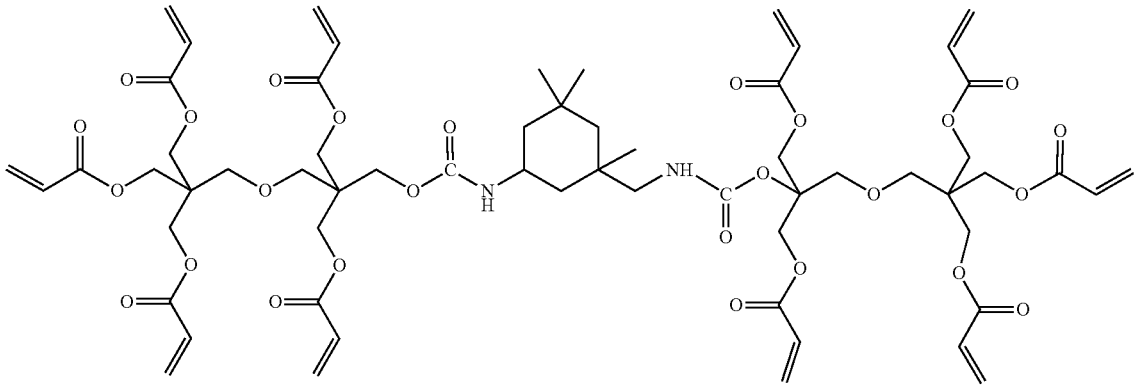

The protective layer may contain an additive, such as an antioxidant, a UV absorber, a plasticizer, a leveling agent, a lubricity-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer may be formed by: preparing a coating liquid for a protective layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, a sulfoxide-based solvent, an ester-based solvent, and an aromatic hydrocarbon-based solvent.

<Method of forming First Structures and Second Structures on Surface of Electrophotographic Photosensitive Drum>

A method of forming the first structures and the second structures on the surface of the electrophotographic photosensitive drum is, for example, (1) a method of forming wrinkle shapes, or (2) a method of forming the structures through embossing. In (1) the method of forming the wrinkle shapes, the wrinkle shapes are obtained by laminating films different from each other in thermal expansion behavior, and heating and cooling the laminate, and a pattern shown in FIG. 1A is formed. As disclosed in Japanese Patent Application Laid-Open No. 2015-161786, (2) the method of forming the structure groups through embossing includes pressing a mold made of a metal or the like against the outer surface of the photosensitive drum to form a pattern, and has been widely known as a technology of imparting a surface shape to the photosensitive drum. Any other method, such as laser ablation, may be used as the method of forming the structure groups.

(1) Method of Forming Wrinkle Shapes

The method of forming the wrinkle shapes includes: forming the protective layer that is a crosslinkable cured film on the charge-transporting layer containing the thermoplastic resin as a main component in the case of the laminated photosensitive layer, or on the single-layer photosensitive layer containing the thermoplastic resin as a main component in the case of the single-layer photosensitive layer; and then subjecting the laminate to heating treatment to produce the wrinkle shapes. Accordingly, when the wrinkle shapes are formed by the method, the outer surface of the electrophotographic photosensitive drum is always the surface of the protective layer arranged directly above the photosensitive layer. It is assumed that at the time of the heating treatment, a compressive stress is applied in the surface direction of the photosensitive drum by a difference in deformation amount between the protective layer and the charge-transporting layer or the single-layer photosensitive layer to buckle the protective layer, and hence the wrinkle shapes are formed. As shown in FIG. 1A, the wrinkle shapes are stripe-shaped uneven shapes that can be observed when the surface of the electrophotographic photosensitive drum is viewed from above, and the shapes are not distributed in a single direction but include, for example, a curve portion, a broken portion, and a branched portion. In the case where a square observation region 100 μm on a side is placed at an arbitrary position on the outer surface and viewed from above, the wrinkle shapes satisfy the following relationship: when a line passing the central point of the observation region and parallel to the peripheral direction of the electrophotographic photosensitive drum is defined as a first reference line L1, and 3,599 reference lines obtained by rotating the first reference line L1 about the central point of the observation region every 0.1° are defined as reference lines L2 to L3600, respectively, each of the reference lines L1 to L3600 intersects the wrinkle shapes at a plurality of sites, and at least two sites selected from the plurality of sites have intersection angles different from each other. To facilitate the understanding of the wrinkle shapes, in the wrinkle shapes shown in FIG. 1A and FIG. 1B, for convenience, one of the first structure group and the second structure group is sampled and schematically shown. Accordingly, in the actual photosensitive drum, the above-mentioned relationship is valid for both of the first structures and the second structures that are the wrinkle shapes.

Figure 1B:
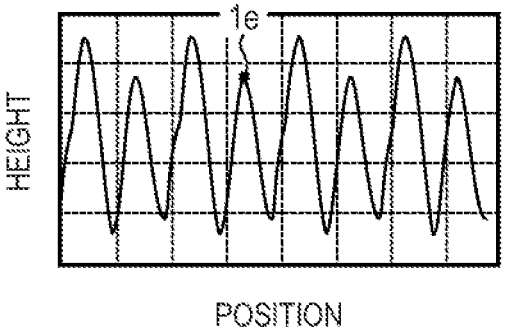

In addition, when the first structures and the second structures are the wrinkle shapes, their heights are determined by identifying a convex portion through the observation of the upper surface of the photosensitive drum. Although a method of identifying the convex portion through the observation of the upper surface is not particularly limited, the portion may be identified by, for example, subjecting height information measured with a confocal laser microscope to image analysis. The heights of the first structures and the second structures can be obtained by identifying the apex of a convex shape represented by reference symbol 1*e* in FIG. 1B. The heights of the first structures and the second structures are each a difference in height between the apex of the convex shape of the wrinkle shape and the bottom point of the concave shape thereof. The average of the heights of the first structures and the average of the heights of the second structures may be determined from the entire region of the photosensitive drum, or may be determined from height information measured in an arbitrary square region 500 μm on a side. The heights of the first structure group and the second structure group may be determined by subjecting the height information to image analysis. A line obtained by connecting the apices of the convex shapes each represented by reference symbol 1*e* in FIG. 1B is a ridge line of the wrinkle shape represented by reference symbol 1*a* in FIG. 1A, and is a straight line or a curve obtained by connecting the convex portions of the stripe-shaped uneven shape when the surface of the electrophotographic photosensitive drum is observed from above.

In addition, all the reference lines intersect the wrinkle shapes at a plurality of sites at different intersection angles, and hence the ridge lines of the wrinkle shapes each have a plurality of curvatures therein. Each of the curvatures is an amount representing the extent to which a curve bends, and when the vicinity of an arbitrary point on the curve is approximated to a circle, the curvature is obtained as the reciprocal of the radius R of the circle as represented by the equation (E). That is, a curvature x is determined from the equation (E) (provided that in the equation (E), "s" represents a length on the curve, and "r" represents the position vector of the arbitrary point on the curve).

$$\chi(s) = \frac{1}{R(s)} = \left| \frac{d^2r}{ds^2} \right| \qquad \text{Equation (E)}$$

For example, at a point represented by reference symbol 1*b* in FIG. 1A, the extent to which the wrinkle ridge line 1*a* bends is large, and hence its curvature is large, while at a point represented by reference symbol 1*c* in FIG. 1A, the extent to which the wrinkle ridge line 1*a* bends is small, and hence its curvature is small. In addition, at a point represented by reference symbol 1*d* in FIG. 1A, the wrinkle ridge line 1*a* is substantially free from bending.

Figure 3A:
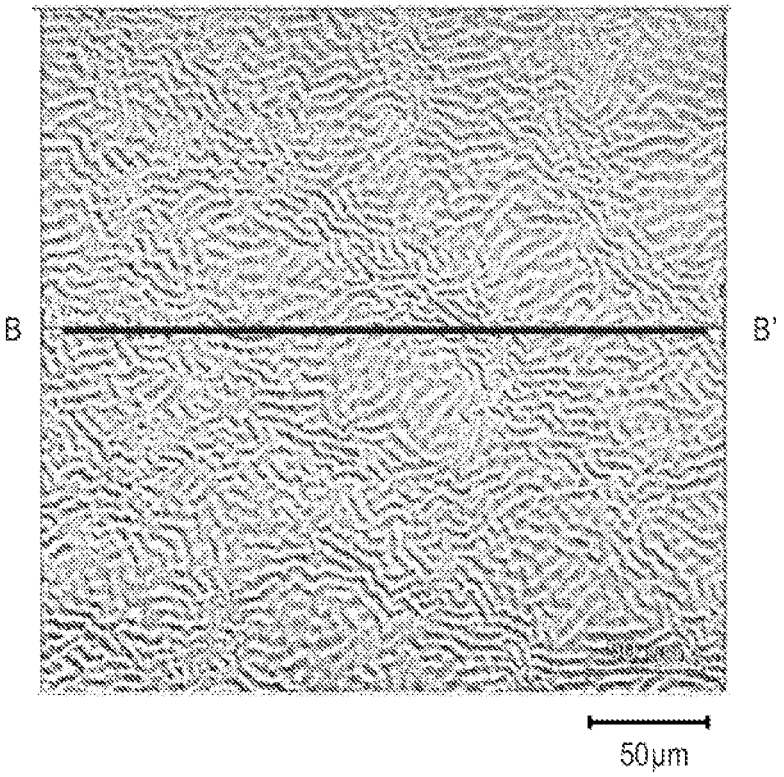
FIG. 3A and FIG. 3B are views for illustrating wrinkle shapes in which a first structure group and a second structure group are composited with each other.
Figure 3B:
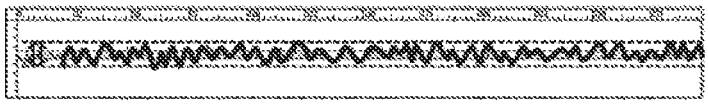

When first heating treatment to be described later is performed after the formation of the protective layer that is a crosslinkable cured film on the charge-transporting layer or the single-layer photosensitive layer, wrinkle shapes shown in FIG. 3A are formed as the first structures on the outer surface of the electrophotographic photosensitive drum. FIG. 3B shows a sectional profile of the wrinkle shapes along the line B-B' of FIG. 3A. As shown in FIG. 3B, the ridge lines of the wrinkle shapes appear at a substantially constant period, and the heights thereof are also substantially constant.

Figure 4A:
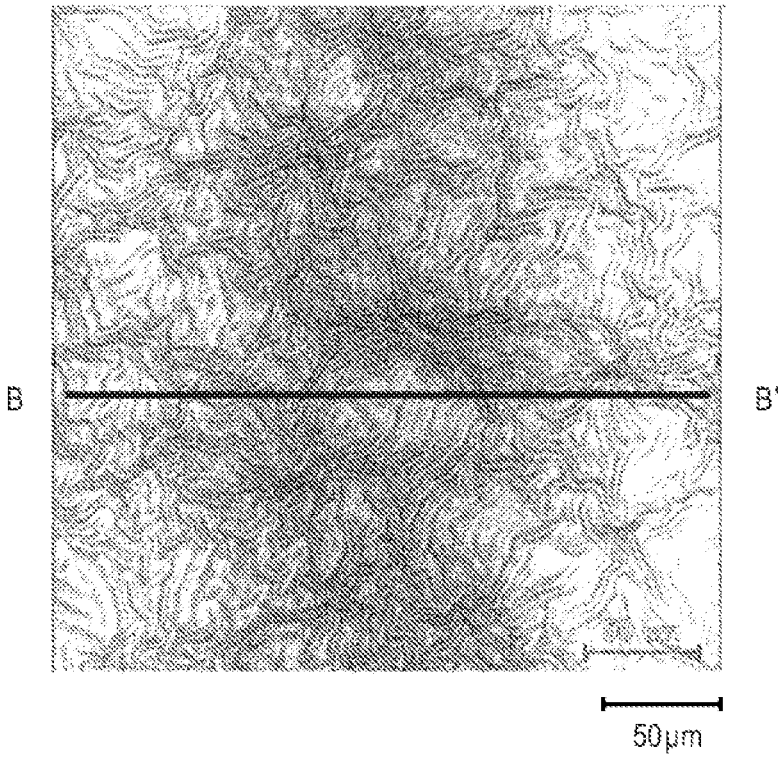
FIG. 4A and FIG. 4B are views for illustrating an approach to quantifying wrinkle shapes.
Figure 4B:
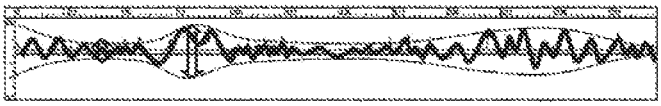

When the electrophotographic photosensitive drum was further subjected to second heating treatment to be described later, as shown in FIG. 4A, the ridge lines of wrinkle shapes having a larger appearance period were found in the first structures serving as the wrinkle shapes having the constant appearance period. FIG. 4B shows a sectional profile of the wrinkle shapes along the line B-B' of FIG. 4A. When the electrophotographic photosensitive drum having formed thereon the wrinkle shapes shown in FIG. 3A and FIG. 3B is further heated, the wrinkle shapes grow, and hence wrinkle shapes having a larger appearance period, high convex portion heights, and large amplitudes are formed as the second structures.

Figure 5A:
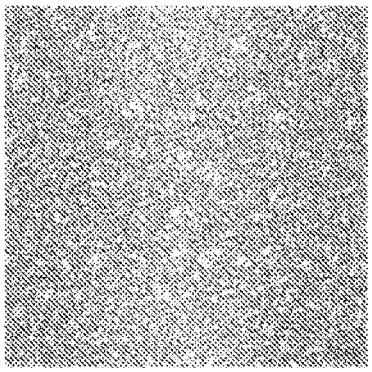
FIG. 5A and FIG. 5B are views for showing the stage at which uniform first structures are formed as wrinkle shapes on the entirety of the outer surface of an electrophotographic photosensitive drum through first heating treatment.
Figure 5B:
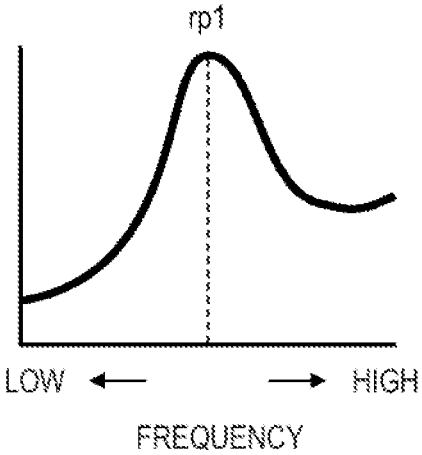
Figure 6A:
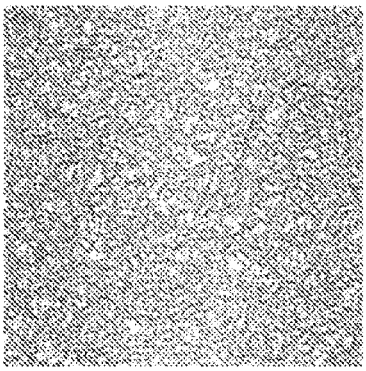
FIG. 6A and FIG. 6B are views for showing the stage at which second structures having an appearance period larger than that of the first structures start to appear as wrinkle shapes through second heating treatment.
Figure 6B:
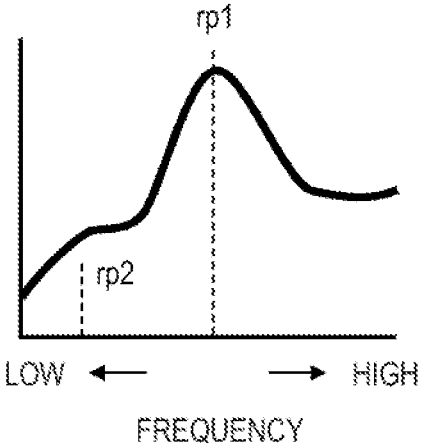
Figure 7A:
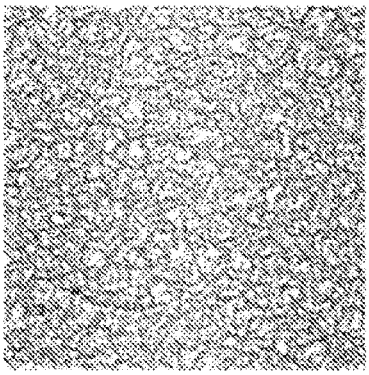
FIG. 7A and FIG. 7B are views for showing the stage at which the second structures serving as wrinkle shapes are made clear by continuing the second heating treatment.
Figure 7B:
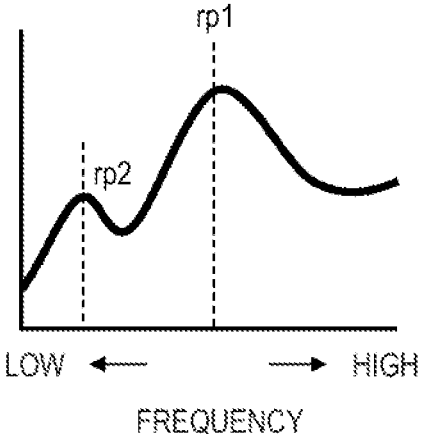

The manner in which the wrinkle shapes grow is described in detail with reference to FIG. 5A and FIG. 5B, FIG. 6A and FIG. 6B, and FIG. 7A and FIG. 7B. FIG. 5A, FIG. 6A, and FIG. 7A are views obtained by viewing the surface of the electrophotographic photosensitive drum from above. FIG. 5B, FIG. 6B, and FIG. 7B each show a radial direction distribution function p(r) obtained as follows: a power spectrum P(k, l) obtained by discrete Fourier transformation when the height information on the wrinkle structures is measured in a square region 500 μm on a side in a data number of N1×N2 is converted from the orthogonal coordinate system (k, l) to the polar coordinate system (r, θ), and the resultant power spectrum F(r, θ) is turned into a one-dimension in the radial direction.

FIG. 5A shows the stage at which after the start of first heating treatment, the buckling of the protective layer occurs to form uniform wrinkle shapes on the entirety of the outer surface of the electrophotographic photosensitive drum. As shown in FIG. 5B, the manner in which the radial direction distribution function p(r) of the wrinkle shapes has a peak at one frequency rp1 is found. The wrinkle shapes having the peak at the frequency rp1 are the first structures. Further, when the heating is continued as second heating treatment, as shown in FIG. 6A, wrinkle shapes having a larger appearance period start to appear. As shown in FIG. 6B, the peak of the radial direction distribution function p(r) of the wrinkle shapes having the larger appearance period appears at a frequency rp2 lower than the frequency rp1. When the heating is further continued, as shown in FIG. 7A, the wrinkle shapes having the larger appearance period become clear. As shown in FIG. 7B, a clear peak of the radial direction distribution function p(r) appears at the frequency rp2 together with the peak having the frequency rp1. The wrinkle shapes having the peak at the frequency rp2 are the second structures. When the heating treatment is performed as described above, as shown in FIG. 7A and FIG. 7B, a desired pattern in which the structures having different appearance periods, that is, the first structures and the second structures are composited with each other is formed on the outer surface of the electrophotographic photosensitive drum.

The mechanism via which the wrinkle shapes are formed is considered to be as follows: when the heating is further performed after the formation of the protective layer on the photosensitive layer, a difference in deformation amount occurs between the protective layer and the photosensitive layer, and as a result, a compressive stress is applied in the surface direction of the electrophotographic photosensitive drum to buckle the protective layer, thereby forming the wrinkle shapes.

The reason why the wrinkle shapes can be finely and uniformly formed is assumed to be as described below.

First, to form the wrinkle shapes, a first solvent and a second solvent having a boiling point higher than that of the first solvent are used in the coating liquid for a charge-transporting layer or the coating liquid for a single-layer photosensitive layer.

The charge-transporting layer or the single-layer photosensitive layer is formed through the first heating treatment including gradually heating the coating film of the coating liquid at a heating temperature lower than the boiling point of the first solvent to dry the coating film. The first heating treatment suppresses rapid evaporation of the solvents from the charge-transporting layer or the single-layer photosensitive layer and rapid curing of the photosensitive layer, and hence the first solvent and the second solvent having different boiling points are each present while being uniformly distributed in the charge-transporting layer or the single-layer photosensitive layer after the first heating treatment. Next, when the heating is performed at a temperature higher than the boiling point of the first solvent in the step of forming the protective layer through the second heating treatment, the first solvent evaporates more rapidly than the second solvent does, and hence the starting points of the buckling are caused by the compressive stress at an interface between the charge-transporting layer or the single-layer photosensitive layer and the protective layer. The starting points uniformly occur at the interface between the charge-transporting layer or the single-layer photosensitive layer and the protective layer, and hence the second solvent gradually evaporates. Thus, moderate deformation of the charge-transporting layer or the single-layer photosensitive layer and the protective layer is secured to enable the formation of fine and uniform wrinkle shapes.

In addition, to form the protective layer having the fine and uniform wrinkle shapes on the outer surface of the photosensitive drum, the amount of the first solvent in the charge-transporting layer or the single-layer photosensitive layer after the first heating treatment needs to be from 0.05 mass % to 2.50 mass % with respect to the total mass of the charge-transporting layer or the single-layer photosensitive layer. When the amount of the first solvent in the charge-transporting layer or the single-layer photosensitive layer after the first heating treatment is less than 0.05 mass %, the first solvent cannot be uniformly distributed in the charge-transporting layer or the single-layer photosensitive layer, and hence the number of the starting points of the buckling reduces. Thus, the uniform wrinkle shapes are hardly formed. When the amount of the first solvent in the charge-transporting layer or the single-layer photosensitive layer after the first heating treatment is more than 2.50 mass %, the degree of the buckling may become larger to enlarge the wrinkle shapes or to reduce the uniformity of the wrinkle shapes. Further, to form the protective layer having the fine and uniform wrinkle shapes on the outer surface of the photosensitive drum, the amount of the second solvent in the charge-transporting layer or the single-layer photosensitive layer after the first heating treatment needs to be from 0.50 mass % to 2.50 mass % with respect to the total mass of the charge-transporting layer or the single-layer photosensitive layer. As in the amount of the first solvent, when the amount of the second solvent in the charge-transporting layer or the single-layer photosensitive layer after the first heating treatment is less than 0.50 mass %, the fine wrinkle shapes are hardly formed, and when the amount is more than 2.50 mass %, the degree of the buckling may become larger to enlarge the wrinkle shapes or to reduce the uniformity of the wrinkle shapes.

A case in which the ratio of the remaining solvent amount of the second solvent to the remaining solvent amount of the first solvent in the charge-transporting layer or the single-layer photosensitive layer after the first heating treatment is from 1.00 to 15.00 is preferred. When the ratio falls within the range, a balance between the first solvent and the second solvent is satisfactory. Thus, the starting points of the buckling caused by the evaporation of the first solvent are finely and uniformly arranged in the entirety of the surface of the electrophotographic photosensitive drum, and hence the wrinkle shapes easily become more fine and more uniform.

The remaining solvent amounts can be appropriately adjusted by a blending ratio between the first solvent and the second solvent at the time of the preparation of the coating liquid for a charge-transporting layer or the coating liquid for a single-layer photosensitive layer, and the heating temperature and a time period in the first heating treatment. A known measurement method may be used as a method of measuring the remaining solvent amounts, and an example thereof is a measurement method including using gas chromatography.

As described above, examples of the solvents to be used in the preparation of the coating liquid for a charge-transporting layer or the coating liquid for a single-layer photosensitive layer include an alcohol-based solvent, a ketone-based solvent, an ether-based solvent, an ester-based solvent, and an aromatic hydrocarbon-based solvent. The first solvent is preferably a solvent having a boiling point of from 90° C. to 150° C., and examples thereof include toluene (boiling point: 111° C.), o-xylene (boiling point: 144° C.), m-xylene (boiling point: 139° C.), and p-xylene (boiling point: 138° C.). The second solvent is preferably a solvent having a boiling point of from 153° C. to 230° C., and examples thereof include methyl benzoate (boiling point: 199° C.), cyclohexanone (boiling point: 156° C.), and diethylene glycol monoethyl ether acetate (boiling point: 217° C.). The first solvent and the second solvent are preferably combined so that a difference between their boiling points may be from 40° C. to 100° C. A low-boiling point solvent may be used in combination with the first solvent and the second solvent. The low-boiling point solvent is preferably a solvent having a boiling point of from 40° C. to 70° C., and examples thereof include tetrahydrofuran and dimethoxymethane.

In the first heating treatment, it is preferred that the coating film be gradually heated from room temperature to a temperature lower than the boiling point of the first solvent by about 10° C. over about 1 hour. In the second heating treatment, the coating film is preferably heated at a heating temperature higher than the boiling point of the second solvent by about 30° C. for a time period that is from about 1.5 times to about 2.5 times as long as the time period of the first heating treatment.

(2) Method of Forming Structures Through Embossing

The method of forming the structures through embossing is, for example, a method including bringing a mold member having an uneven shape into pressure contact with the electrophotographic photosensitive drum to transfer the uneven shape of the mold member onto the surface of the electrophotographic photosensitive drum. Although the formation of the structures through embossing enables the production of a photosensitive drum free of any protective layer, the structure groups may be formed through embossing also in a photosensitive drum having a protective layer. When the structures are formed through embossing, as in the wrinkle shapes, the heights of the first structures and the second structures are each a difference in height between the apex of the structure and the bottom point of the concave shape thereof. The average of the heights of the first structures and the average of the heights of the second structures may be determined from the entire region of the photosensitive drum, or may be determined from height information measured in an arbitrary square region 500 μm on a side.

Figure 8:
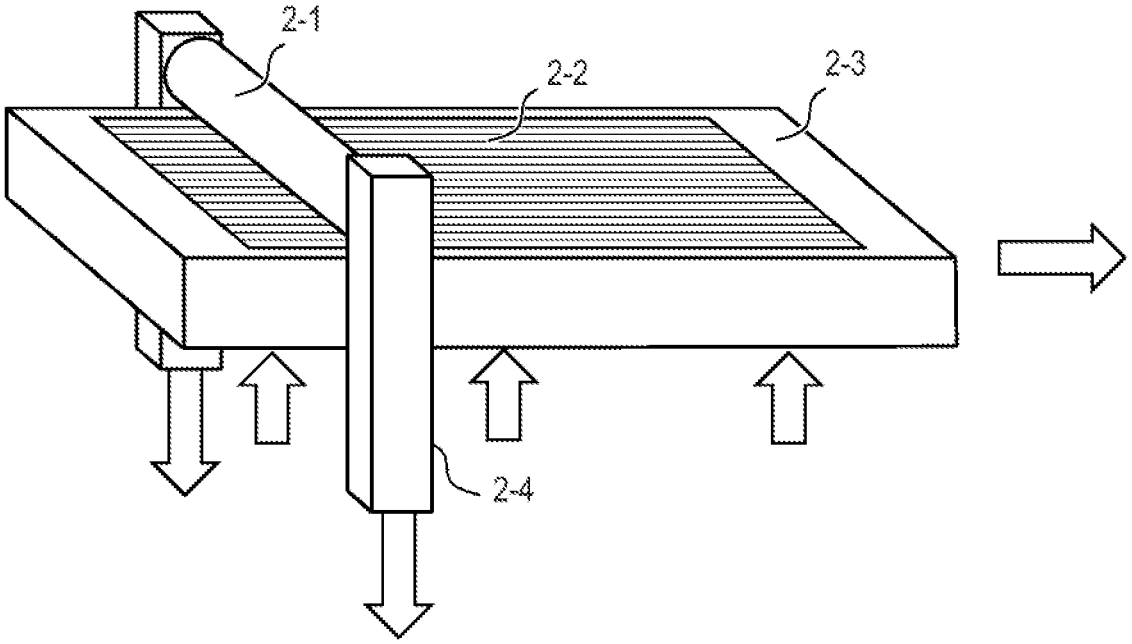
FIG. 8 is a view for illustrating a processing apparatus configured to form an embossed pattern.

FIG. 8 is an illustration of an example of a pressure-contact shape transfer processing apparatus for forming concave portions on the surface of the electrophotographic photosensitive drum.

According to the pressure-contact shape transfer processing apparatus illustrated in FIG. 8, the concave portions can be formed on the surface of an electrophotographic photosensitive drum 2-1 serving as a work piece by continuously bringing a mold member 2-2 into contact with the outer surface of the electrophotographic photosensitive drum 2-1 to pressurize the outer surface while rotating the photosensitive drum.

A material for a pressurizing member 2-3 is, for example, a metal, a metal oxide, plastic, or glass. Of those, stainless steel (SUS) is preferred from the viewpoints of mechanical strength, dimensional accuracy, and durability. The mold member is arranged on the upper surface of the pressurizing member 2-3. In addition, the mold member 2-2 can be brought into contact with the surface of the electrophotographic photosensitive drum 2-1 supported by supporting members 2-4 at a predetermined pressure by a supporting member (not shown) and a pressurizing system (not shown) arranged on the lower surface side of the pressurizing member. In addition, the supporting members 2-4 may be pressed against the pressurizing member 2-3 at a predetermined pressure, or the supporting members 2-4 and the pressurizing member 2-3 may be pressed against each other.

The example illustrated in FIG. 8 is an example in which the pressurizing member 2-3 is moved in a direction vertical to the shaft direction of the electrophotographic photosensitive drum 2-1 to continuously process the surface of the electrophotographic photosensitive drum 2-1 while causing or driving the photosensitive drum to rotate. Further, the surface of the electrophotographic photosensitive drum 2-1 may be continuously processed by moving the supporting members 2-4 in the direction vertical to the shaft direction of the electrophotographic photosensitive drum 2-1 while fixing the pressurizing member 2-3, or by moving both of the supporting members 2-4 and the pressurizing member 2-3.

The mold member 2-2 and the electrophotographic photosensitive drum 2-1 are preferably heated from the viewpoint of efficiently transferring the shape of the mold member.

Examples of the mold member 2-2 include: a metal or a resin film subjected to fine surface processing; a product obtained by pattering the surface of a silicon wafer or the like with a resist; a resin film having dispersed therein fine particles; and a product obtained by coating a resin film having a fine surface shape with a metal.

In addition, an elastic body is preferably arranged between the mold member 2-2 and the pressurizing member 2-3 from the viewpoint of uniformizing the pressure at which the mold member is pressed against the electrophotographic photosensitive drum 2-1.

Although the heating of the mold member is not essential, from the viewpoint of efficiently and stably performing the shape transfer, the mold member 2-2 is preferably heated so that the temperature of the surface of the electrophotographic photosensitive drum 2-1 in the portion of the photosensitive drum brought into pressure contact with the mold member 2-2 may be equal to or more than the glass transition point Tg of the resin in the surface layer of the photosensitive drum.

[Approach to Evaluating Shape of Outer Surface of Electrophotographic Photosensitive Drum]

An example of an approach to evaluating the height information on the shape of the outer surface of the electrophotographic photosensitive drum is described below.

<Method of Measuring Height Information>

In the measurement of the height information, heights at the respective positions on the outer surface of the photosensitive drum are measured with an apparatus to be described later. The measurement of the height information is performed based on the result of the measurement of the three-dimensional surface shape data of the outer surface of the photosensitive drum, and a method of measuring the three-dimensional surface shape data is not particularly limited. For example, a commercial atomic force microscope, electron microscope, laser microscope, optical microscope, or three-dimensional surface shape-measuring machine of an optical interference system may be utilized.

For example, the following microscopes may each be utilized as the atomic force microscope.

- A scanning probe microscope NEOS (manufactured by Bruker Nano Surface Analysis)
- A nanoscale hybrid microscope VN-8000 (manufactured by Keyence Corporation)
- A scanning probe microscope NanoNavi Station (manufactured by SII NanoTechnology Inc.)
- A scanning probe microscope SPM-9600 (manufactured by Shimadzu Corporation)

For example, the following microscopes may each be utilized as the electron microscope.

- A 3D real surface view microscope VE-9800 (manufactured by Keyence Corporation)
- A 3D real surface view microscope VE-8800 (manufactured by Keyence Corporation)
- A scanning electron microscope Conventional/Variable Pressure SEM (manufactured by SII NanoTechnology Inc.)
- A scanning electron microscope SUPERSCAN SS-550 (manufactured by Shimadzu Corporation)

For example, the following microscopes may each be utilized as the laser microscope.

- An ultra-deep shape-measuring microscope VK-8550 (manufactured by Keyence Corporation)
- An ultra-deep shape-measuring microscope VK-9500 (manufactured by Keyence Corporation)
- An ultra-deep shape-measuring microscope VK-9700 (manufactured by Keyence Corporation)
- A surface shape-measuring system Surface Explorer SX-520DR Type (manufactured by Ryoka Systems Inc.)
- A scanning confocal laser microscope OLS4000 (manufactured by Olympus Corporation)
- A real color confocal microscope OPTELICS C130 (manufactured by Lasertec Corporation)

For example, the following microscopes may each be utilized as the optical microscope.

- A digital microscope VHX-500 (manufactured by Keyence Corporation)
- A digital microscope VHX-10s00 (manufactured by Keyence Corporation)
- A 3D digital microscope VC-7700 (manufactured by OMRON Corporation)

For example, the following machines may each be utilized as the three-dimensional surface shape-measuring machine of an optical interference system.

- A white interference measuring system R6500H (manufactured by Ryoka Systems Inc.)
- A non-contact three-dimensional surface property/step-measuring machine TALYSURF CCI 6000 (manufactured by AMETEK, Inc.)

The three-dimensional surface shape data can be obtained by measuring vertical direction height data z(x, y) corresponding to horizontal direction coordinates (x, y) with any one of the above-mentioned measuring machines.

<Method of Analyzing Height Information>

As described in the foregoing, the height information on the resultant electrophotographic photosensitive drum can be obtained by measuring the height information on the outer surface thereof obtained from the three-dimensional surface shape data and analyzing the result through use of two-dimensional Fourier transformation. The radial direction distribution function p(r) obtained by turning the power spectrum F(r, θ) of the uneven shape of the outer surface into a one-dimension in the radial direction is subjected to frequency analysis, followed by the determination of the angle distribution q1($\theta_1$) of a two-dimensional power spectrum $F_1$(rp$_1$, $\theta_1$) at the frequency rp1 at which the radial direction distribution function p(r) becomes a local maximum, and the angle distribution q2($\theta_2$) of a two-dimensional power spectrum $F_2$(rp2, $\theta_2$) at the frequency rp2 at which the radial direction distribution function p(r) becomes a local maximum.

An approach to evaluating the distribution function of the uneven shape of the resultant electrophotographic photosensitive drum includes judging whether or not the radial direction distribution function p(r) has a plurality of peaks. That is, when the radial direction distribution function p(r) of the uneven shape has at least two peaks, and the average of the heights of the structures of the photosensitive drum corresponding to a peak at higher frequencies is lower than the average of the heights of the structures thereof corresponding to a peak at lower frequencies, the requirements of the electrophotographic photosensitive drum of the present disclosure are satisfied. Further, the approach includes judging whether or not the angle distributions q1(θ) and q2(θ) are each uniform in the entire range of the θ. A case in which variation in power value $F_1$ in the entire range of the $\theta_1$ is 10% or less, and variation in power value $F_2$ in the entire range of the $\theta_2$ is 10% or less means that the first structures and the second structures are isotropically arranged on the outer surface of the electrophotographic photosensitive drum.

The features of the surface shape of the electrophotographic photosensitive drum can be judged through the foregoing processing.

Accordingly, in the case of such a uniform pattern as shown in FIG. 3A and FIG. 3B, while satisfactory image transferability is exhibited, a torque-reducing effect is not sufficient. When a pattern having a larger appearance period starts to be formed in addition to the uniform pattern having a small appearance period as shown in FIG. 4A and FIG. 4B, the torque-reducing effect starts to be obtained. When the pattern having a small appearance period and the pattern having a large appearance period are composited with each other, both of a reduction in torque and an improvement in image transferability can be achieved.

[Process Cartridge and Electrophotographic Image Forming Apparatus]

A process cartridge of the present disclosure integrally supports the electrophotographic photosensitive drum described above, and at least one unit selected from the group consisting of a charging unit, a developing unit, a transferring unit, and a cleaning unit, and is removably mounted onto a main body of an electrophotographic image forming apparatus.

In addition, an electrophotographic image forming apparatus of the present disclosure includes the electrophotographic photosensitive drum described above, and at least one unit selected from the group consisting of a charging unit, an exposing unit, a developing unit, and a transferring unit.

Figure 9:
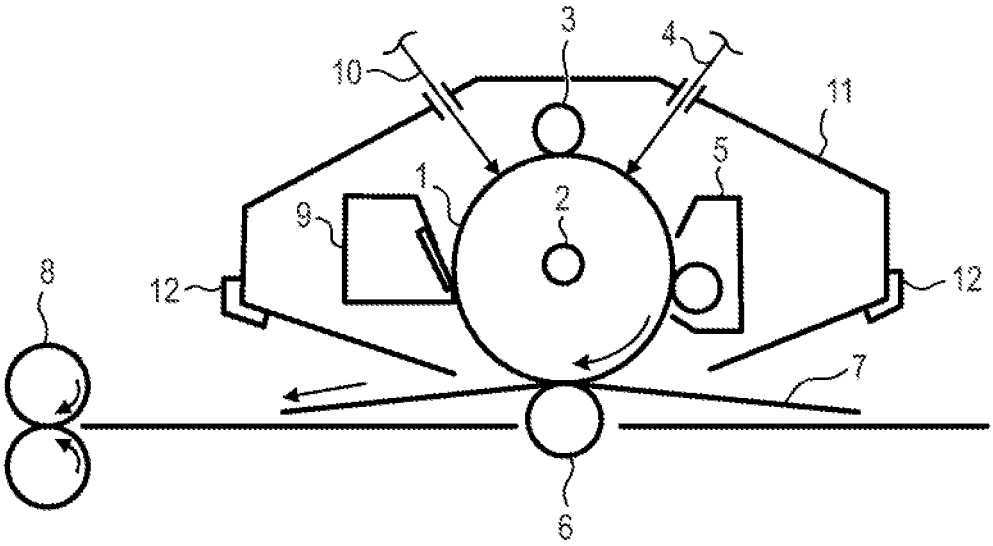
FIG. 9 is a conceptual view for illustrating an electrophotographic image output apparatus.

An example of the schematic construction of an electrophotographic image forming apparatus including a process cartridge including an electrophotographic photosensitive drum is illustrated in FIG. 9.

A cylindrical electrophotographic photosensitive drum 1 is rotationally driven about a shaft 2 in an arrow direction at a predetermined peripheral speed. The surface of the electrophotographic photosensitive drum 1 is charged to a predetermined positive or negative potential by a charging unit 3. Although a roller charging system based on a roller type charging member is illustrated in FIG. 9, a charging system such as a corona charging system, a proximity charging system, or an injection charging system may be adopted. The charged surface of the electrophotographic photosensitive drum 1 is irradiated with exposure light 4 from an exposing unit (not shown), and hence an electrostatic latent image corresponding to target image information is formed thereon. The electrostatic latent image formed on the surface of the electrophotographic photosensitive drum 1 is developed with a toner stored in a developing unit 5, and a toner image is formed on the surface of the electrophotographic photosensitive drum 1. The toner image formed on the surface of the electrophotographic photosensitive drum 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic image forming apparatus. The electrophotographic image forming apparatus may include a cleaning unit 9 for removing a deposit, such as the toner remaining on the surface of the electrophotographic photosensitive drum 1 after the transfer. In addition, a so-called cleaner-less system configured to remove the deposit with the developing unit or the like without separate arrangement of the cleaning unit may be used. The electrophotographic image forming apparatus may include an electricity-removing mechanism configured to subject the surface of the electrophotographic photosensitive drum 1 to electricity-removing treatment with pre-exposure light 10 from a pre-exposing unit (not shown). In addition, a guiding unit 12, such as a rail, may be arranged for removably mounting a process cartridge 11 onto the main body of an electrophotographic image forming apparatus.

The electrophotographic photosensitive drum may be used in, for example, a laser beam printer, an LED printer, and a copying machine.

According to the present disclosure, both of a reduction in torque of the electrophotographic photosensitive drum at the time of its cleaning and an improvement in image transferability can be achieved.

EXAMPLES

The present disclosure is described in more detail below by way of Examples and Comparative Example. The present disclosure is by no means limited to the following Examples, and various modifications may be made without departing from the gist of the present disclosure. In the description in the following Examples, "part(s)" is by mass unless otherwise specified. The thickness of each of the layers of the electrophotographic photosensitive drums of Examples and Comparative Example was determined with an eddy current-type thickness meter (Fischerscope, manufactured by Fischer Instruments K.K.), or was determined from a mass per unit area in terms of specific gravity.

<Production of Electrophotographic Photosensitive Drum 1>

Example 1

An aluminum cylinder (JIS-A3003, aluminum alloy) having a diameter of 24 mm and a length of 257.5 mm was used as a support (conductive support).

Next, the following materials were prepared.

| | |
|---|---|
| Titanium oxide ($TiO_2$) particles coated with oxygen-deficient tin oxide ($SnO_2$), the particles serving as metal oxide particles (average primary particle diameter: 230 nm) | 214 parts |
| A phenol resin (monomer/oligomer of a phenol resin) (product name: PLYOPHEN J-325, manufactured by Dainippon Ink & Chemicals, Inc., resin solid content: 60 mass %) serving as a binding material | 132 parts |
| 1-Methoxy-2-propanol serving as a solvent | 98 parts |

Those materials were loaded into a sand mill using 450 parts of glass beads each having a diameter of 0.8 mm, and were subjected to dispersion treatment under the conditions of a number of revolutions of 2,000 rpm, a dispersion treatment time of 4.5 hours, and a set temperature of cooling water of 18° C. to provide a dispersion liquid. The glass beads were removed from the dispersion liquid with a mesh (aperture: 150 μm). Silicone resin particles (product name: TOSPEARL 120, manufactured by Momentive Performance Materials Inc., average particle diameter: 2 μm) serving as a surface roughness-imparting agent were added to the resultant dispersion liquid. The addition amount of the silicone resin particles was set to 10 mass % with respect to the total mass of the metal oxide particles and the binding material in the dispersion liquid after the removal of the glass beads. In addition, a silicone oil (product name: SH28PA, manufactured by Dow Corning Toray Co., Ltd.) serving as a leveling agent was added to the dispersion liquid so that its addition amount became 0.01 mass % with respect to the total mass of the metal oxide particles and the binding material in the dispersion liquid. Next, a mixed solvent of methanol and 1-methoxy-2-propanol (mass ratio: 1:1) was added to the dispersion liquid so that the total mass of the metal oxide particles, the binding material, and the surface roughness-imparting agent (i.e., the mass of a solid content) in the dispersion liquid became 67 mass % with respect to the mass of the dispersion liquid. After that, the mixture was stirred to prepare a coating liquid for a conductive layer. The coating liquid for a conductive layer was applied onto the support by dip coating, and the applied liquid was heated at 140° C. for 1 hour to form a conductive layer having a thickness of 30 μm.

Next, the following materials were prepared.

| | |
|---|---|
| Electron-transporting material represented by the formula (E-1) | 4 parts |
| Blocked isocyanate (product name: DURANATE SBN-70D, manufactured by Asahi Kasei Chemicals Corporation) | 5.5 parts |
| Polyvinyl butyral resin (S-LEC KS-5Z, manufactured by Sekisui Chemical Co., Ltd.) | 0.3 part |
| Zinc(II) hexanoate serving as a catalyst (manufactured by Mitsuwa Chemicals Co., Ltd.) | 0.05 part |

Those materials were dissolved in a mixed solvent containing 50 parts of tetrahydrofuran and 50 parts of 1-methoxy-2-propanol to prepare a coating liquid for an undercoat layer. The coating liquid for an undercoat layer was applied onto the conductive layer by dip coating, and was heated at 170° C. for 30 minutes to form an undercoat layer having a thickness of 0.7 μm.

(E-1)

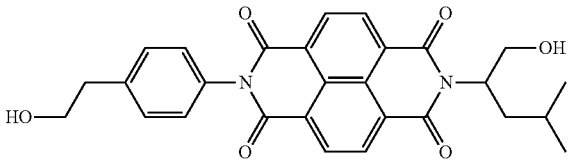

Next, 10 parts of hydroxygallium phthalocyanine of a crystal form having peaks at positions of 7.5° and 28.4° in a chart obtained by its CuKα characteristic X-ray diffraction and 5 parts of a polyvinyl butyral resin (product name: S-LEC BX-1, manufactured by Sekisui Chemical Co., Ltd.) were prepared. Those materials were added to 200 parts of cyclohexanone, and were dispersed therein with a sand mill apparatus using glass beads each having a diameter of 0.9 mm for 6 hours. 150 Parts of cyclohexanone and 350 parts of ethyl acetate were further added to the dispersion liquid to dilute the dispersion liquid. Thus, a coating liquid for a charge-generating layer was obtained. The resultant coating liquid was applied onto the undercoat layer by dip coating, and was dried at 95° C. for 10 minutes to form a charge-generating layer having a thickness of 0.20 μm.

The measurement of X-ray diffraction was performed under the following conditions.

[Powder X-Ray Diffraction Measurement]

Measurement apparatus used: X-ray diffraction apparatus RINT-TTRII, manufactured by Rigaku Corporation X-ray tube bulb: Cu Tube voltage: 50 KV Tube current: 300 mA Scan method: 2θ/θ scan Scan speed: 4.0°/min Sampling interval: 0.02°

Start angle (2θ): 5.0°

Stop angle (2θ): 40.0°

Attachment: standard sample holder

Filter: not used

Incident monochrome: used

Counter monochrometer: not used

Divergent slit: open

Divergent longitudinal restriction slit: 10.00 mm

Scattering slit: open

Light receiving slit: open

Flat sheet monochrometer: used

Counter: scintillation counter

Next, the following materials were prepared.

| | |
|---|---|
| Charge-transporting material (hole-transportable material) represented by the formula (1-4) | 5 parts |
| Charge-transporting material (hole-transportable material) represented by the formula (1-6) | 5 parts |
| Polycarbonate (product name: IUPILON Z400, manufactured by Mitsubishi Engineering-Plastics Corporation) | 10 parts |

-continued

| | |
|---|---|
| Polycarbonate resin having copolymerization units represented by the structural formula (C-4) and the structural formula (C-5) (x/y = 0.95/0.05: viscosity-average molecular weight = 20,000) | 0.02 part |

Those materials were dissolved in a mixed solvent of 60 parts of toluene, 2.3 parts of methyl benzoate, and 12.8 parts of tetrahydrofuran to prepare a coating liquid for a charge-transporting layer. The coating liquid for a charge-transporting layer was applied onto the charge-generating layer by dip coating to form a coating film, and the coating film was dried at 100° C. for 20 minutes to form a charge-transporting layer having a thickness of 16 μm.

(C-4)

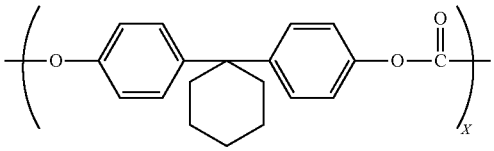

(C-5)

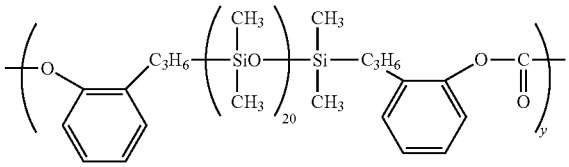

The remaining solvent amounts of the charge-transporting layer were measured with a gas chromatography mass spectrometer (product name: HP6890, manufactured by Hewlett-Packard Company) including a head space sampler and a detector (product name: HP5973, manufactured by Hewlett-Packard Company). With regard to measurement conditions for gas chromatography-mass spectrometry, the charge-transporting layer was peeled from an electrophotographic photosensitive drum with the head space sampler, and was heated at 150° C. for 30 minutes, followed by the measurement of the amount of a produced gas with the gas chromatography mass spectrometer (product name: HP6890, manufactured by Hewlett-Packard Company) and the detector (product name: HP5973, manufactured by Hewlett-Packard Company). The measurement was performed by using HP-5MS (copolymer containing 5% of diphenylpolysiloxane and 95% of dimethylpolysiloxane, thickness: 0.25 μm, inner diameter: 0.25 mm, length: 30 m) manufactured by Hewlett-Packard Company as a capillary column and He (1 ml/min) as a carrier gas under the following conditions: the column was held at 40° C. for 3 minutes; as a first-stage temperature increase, the temperature of the column was increased from 40° C. to 70° C. at a rate of temperature increase of 2° C./min; as a second-stage temperature increase, the temperature of the column was increased from 70° C. to 150° C. at a rate of temperature increase of 5° C./min; and as a third-stage temperature increase, the temperature of the column was increased from 150° C. to 300° C. at a rate of temperature increase of 10° C./min. A calibration curve was produced by using the solvents to be used in the charge-transporting layer as reference substances for a calibration curve, and the amounts of the solvents remaining in the charge-transporting layer were determined. The results are shown in Table 1.

Next, the following materials were prepared.

| | |
|---|---|
| Compound represented by the formula (2-1) | 8 parts |
| Compound represented by the formula (3-1) | 16 parts |
| Siloxane-modified acrylic compound (SYMAC US270, manufactured by Toagosei Co., Ltd.) | 0.1 part |

Those materials were mixed into 58 parts of cyclohexane and 25 parts of 1-propanol, and the mixture was stirred. Thus, a coating liquid for a protective layer was prepared.

The coating liquid for a protective layer was applied onto the charge-transporting layer by dip coating to form a coating film, and the resultant coating film was dried at 40° C. for 5 minutes. After that, under a nitrogen atmosphere, the coating film was irradiated with electron beams for 1.6 seconds under the conditions of an acceleration voltage of 70 kV and a beam current of 5.0 mA while the support (irradiation target body) was rotated at a speed of 300 rpm. Thus, the coating film of the coating liquid for a protective layer was cured. The dose of the electron beams at a position on the outermost surface layer of the support was 15 kGy. After that, under the nitrogen atmosphere, first heating was performed by increasing the temperature of the coating film from 25° C. to 100° C. over 20 seconds. Thus, a protective layer having a thickness of 1.5 μm was formed. An oxygen concentration during a period from the electron beam irradiation to the subsequent heating treatment was 10 ppm or less. Next, in the air, the coating film was naturally cooled until its temperature became 25° C., and second heating treatment was performed for 25 minutes under such a condition that the temperature of the coating film became 220° C., thereby forming wrinkle shapes. Thus, an electrophotographic photosensitive drum of Example 1 including the protective layer was produced.

Examples 2 to 5

Electrophotographic photosensitive drums were each produced in the same manner as in Example 1 except that: the kinds of the charge-transporting materials were changed as shown in Table 1; and the conditions under which the second heating treatment was performed were changed as shown in Table 2.

Reference Example 1

An electrophotographic photosensitive drum was produced in the same manner as in Example 1 except that: the kinds of the charge-transporting materials were changed as shown in Table 1; and the conditions under which the second heating treatment was performed were changed as shown in Table 2.

Comparative Example 1

Figure 10:
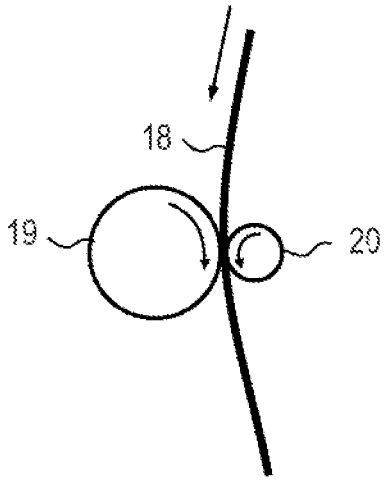
FIG. 10 is a view for illustrating a polishing machine.

A photosensitive drum produced as follows was prepared: the temperature of the second heating treatment of the electrophotographic photosensitive drum of Example 1 was changed to 120° C., and no wrinkle shapes were formed. The outer surface of the photosensitive drum was polished with a polishing machine illustrated in FIG. 10 under the following conditions.

| | |
|---|---|
| Feeding speed of a polishing sheet: | 400 mm/min |
| Number of revolutions of the | 240 rpm |

-continued

| | |
|---|---|
| photosensitive drum: | |
| Polishing grains: | Silicon carbide |
| Average particle diameter of the polishing grains: | 3 μm |
| Polishing time: | 20 seconds |

A method for the polishing was as described below. While a polishing sheet 18 obtained by arranging, on a sheet-shaped substrate, a layer obtained by dispersing the polishing grains in a binder resin was fed in an arrow direction, an electrophotographic photosensitive drum 19 was subjected to surface roughening treatment by being pressed against a backup roller 20 for 20 seconds while being rotated in an arrow direction. Thus, an electrophotographic photosensitive drum having a flaw in its peripheral direction was produced. The surface roughness Ra of the photosensitive drum after the surface roughening was evaluated under the same conditions as those of the measurement of an appearance period. As a result, the surface roughness was 0.018 μm.

TABLE 1

| | Charge-transporting layer | | | | First solvent | | Second solvent | | Other solvent | |
|---|---|---|---|---|---|---|---|---|---|---|
| | Kind | Part(s) by mass | Kind | Part(s) by mass | Kind | Part(s) by mass | Kind | Part(s) by mass | Kind | Part(s) by mass |
| Example 1 | (1-4) | 5 | (1-6) | 5 | Toluene | 60 | Methyl benzoate | 2.3 | Tetrahydrofuran | 12.8 |
| Example 2 | (1-1) | 5 | (1-3) | 5 | Toluene | 45 | Cyclohexanone | 22.5 | Dimethoxymethane | 7.5 |
| Example 3 | (1-4) | 5 | (1-6) | 5 | Toluene | 60 | Methyl benzoate | 2.3 | Tetrahydrofuran | 12.8 |
| Example 4 | (1-1) | 5 | (1-3) | 5 | Toluene | 45 | Cyclohexanone | 22.5 | Dimethoxymethane | 7.5 |
| Example 5 | (1-4) | 5 | (1-6) | 5 | Toluene | 60 | Methyl benzoate | 2.3 | Tetrahydrofuran | 12.8 |
| Comparative Example 1 | (1-4) | 5 | (1-6) | 5 | Toluene | 60 | Methyl benzoate | 2.3 | Tetrahydrofuran | 12.8 |
| Reference Example 1 | (1-1) | 5 | (1-3) | 5 | Toluene | 45 | Cyclohexanone | 22.5 | Dimethoxymethane | 7.5 |

TABLE 2

| | Protective layer | | | | | Conditions for second heating | |
|---|---|---|---|---|---|---|---|
| | Kind | Part(s) by mass | Kind | Part(s) by mass | Thickness (μm) | Temperature | Minute(s) |
| Example 1 | (2-1) | 8 | (3-1) | 16 | 0.5 | 220° C. | 25 |
| Example 2 | (2-1) | 8 | (3-1) | 16 | 0.5 | 180° C. | 25 |
| Example 3 | (2-1) | 8 | (3-1) | 16 | 0.5 | 160° C. | 25 |
| Example 4 | (2-1) | 8 | (3-1) | 16 | 0.5 | 190° C. | 35 |
| Example 5 | (2-1) | 8 | (3-1) | 16 | 0.5 | 170° C. | 35 |
| Comparative Example 1 | (2-1) | 8 | (3-1) | 16 | 2 | 120° C. | 15 |
| Reference Example 1 | (2-1) | 8 | (3-1) | 16 | 0.5 | 180° C. | 15 |

<Evaluation>

The photosensitive drums produced in Examples 1 to 5, Reference Example 1, and Comparative Example 1 were each evaluated under the following conditions.

• Evaluation of Outer Surface Shape

The peripheral surface shape of each of the electrophotographic photosensitive drums of Examples 1 to 5 was observed with a laser microscope (product name: VK-X200, manufactured by Keyence Corporation) at a certain magnification, and the number of the peaks of structures included in each of a first structure group and a second structure group, and the appearance period, average height, and isotropy of the structures were evaluated through the analysis of the resultant data by the methods described above. The appearance period was calculated from the frequency of the peaks. In addition, with regard to the isotropy, the angle distribution $q(\theta)$ of a power spectrum $F(rp, \theta)$ was calculated at the frequency at which the appearance of each of the first structure group and the second structure group became a local maximum, and when variation in power value in the entire range of the $\theta$ was 10% or less, the structures were judged to be isotropic. Visual observation of the peripheral surface shape of the electrophotographic photosensitive drum of Comparative Example 1 showed that shapes on its surface were anisotropically arranged. The results are shown in Table 3.

A reconstructed machine of a laser beam printer manufactured by Hewlett-Packard Company (product name: HP LaserJet Enterprise Color M553dn) was used in the evaluations of torque, a cleaning property, and transferability. With regard to reconstruction points, the printer was reconstructed so that the quantity of the drive current of the rotary motor of its photosensitive drum was able to be measured, so that a voltage to be applied to its charging roller was able to be regulated and measured, and so that an image exposure light quantity was able to be regulated and measured. The average particle diameter of the toner used is 6.8 μm.

The photosensitive drums of Examples and Comparative Example were each mounted on the cyan color cartridge of the image forming apparatus, and a test chart having a print percentage of 5% was output on 100 sheets of A4 size plain paper. As a charging condition, a dark portion potential was adjusted to −500 V, and as an exposure condition, the image exposure light quantity was adjusted to 0.25 μJ/cm$^2$.

• Evaluation of Torque

A drive current value at the time of the output on the 100th sheet with the evaluation apparatus was defined as a current value A. In addition, an electrophotographic photosensitive drum free of any wrinkle shapes on its outer surface was produced in the same manner as in the production of the electrophotographic photosensitive drum of Example 1 except that the second heating treatment was not performed. The drum was defined as a control electrophotographic photosensitive drum. The control electrophotographic photosensitive drum was mounted on the evaluation apparatus, and a drive current value at the time of the output of the test chart on the 100th sheet of the plain paper with the apparatus was defined as a current value B.

The ratio (current value A/current value B) of the current value A to the current value B thus obtained was defined as a torque relative value. A case in which the torque relative value is 0.7 or less means that a frictional force between the electrophotographic photosensitive drum and a cleaning blade is sufficiently reduced.

The results are shown in Table 3.

• Evaluation of Cleaning Property

A halftone image having a toner laid-on level of 0.2 mg/cm$^2$ was printed on 5 sheets of the plain paper with the evaluation apparatus, and was evaluated. The results are shown in Table 3. Cases in which the results of the evaluation are A and B each mean that the electrophotographic photosensitive drum has a sufficient cleaning property.

A: No cleaning failure image is present, and the contamination of the charging roller is absent.

B: No cleaning failure image is present, but the contamination of the charging roller is present.

C: A cleaning failure can be slightly observed on the halftone image.

D: A cleaning failure is conspicuous on the halftone image.

• Evaluation of Transferability

A solid image having a toner laid-on level of 0.5 mg/cm$^2$ was output with the evaluation apparatus, and the photosensitive drum was stopped during the image formation, followed by the evaluation of the amount of the residual toner. The evaluation was performed by setting a transfer bias to a value lower than a normal setting, that is, to 800 V for recognizing a significant difference. Transfer efficiency was determined by dividing the amount of the toner remaining after the transfer by the amount of the toner used in the development. The results are shown in Table 3. Cases in which the results of the evaluation are A and B each mean that the photosensitive drum has sufficient transferability.

A: The transfer efficiency is 95% or more.

B: The transfer efficiency is 90% or more.

C: The transfer efficiency is 80% or more.

D: The transfer efficiency is less than 80%.

TABLE 3

| | Number | First structures | | Second structures | | | Torque | | |
|---|---|---|---|---|---|---|---|---|---|
| | of peaks | Period (μm) | Height (μm) | Period (μm) | Height (μm) | Shape directivity | relative value | Transfer-ability | Cleaning property |
| Example 1 | 2 | 3.1 | 0.5 | 22 | 1.2 | Isotropic | 0.68 | B | A |
| Example 2 | 2 | 3.3 | 0.7 | 24 | 1.3 | Isotropic | 0.68 | B | A |
| Example 3 | 2 | 2.9 | 0.6 | 21 | 1.4 | Isotropic | 0.67 | B | A |
| Example 4 | 2 | 3.2 | 0.6 | 26 | 1.7 | Isotropic | 0.65 | B | A |
| Example 5 | 2 | 3.3 | 0.7 | 28 | 1.8 | Isotropic | 0.64 | B | A |
| Comparative Example 1 | 0 | — | — | — | — | Anisotropic | 0.72 | B | A |
| Reference Example 1 | 1 | 3.2 | 0.6 | — | — | Isotropic | 0.75 | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-075648, filed Apr. 21, 2020, which is hereby incorporated by reference herein in its entirety.

What is claimed is:

1. An electrophotographic photosensitive member having drum shape, the electrophotographic photosensitive member comprising:

a support; and a photosensitive layer on the support, an outer surface of the electrophotographic photosensitive member comprising a first structure group and a second structure group comprising structures having different appearance periods, an appearance period of the first structure group being smaller than an appearance period of the second structure group, and a height of the first structure group being lower than a height of the second structure group, wherein the structures included in the first structure group and the structures included in the second structure group are such that when a square observation region 100 μm on a side is placed at an arbitrary position on the outer surface, a line passing a central point of the observation region and parallel to a peripheral direction of the electrophotographic photosensitive member is defined as a first reference line L1, with 3,599 reference lines obtained by rotating the first reference line L1 about the central point every 0.1° respectively defined as reference lines L2 to L3600, each of L1 to L3600 intersects the structures included in the first structure group at a plurality of sites, at least two sites selected from the plurality of sites have intersection angles different from each other, each of the reference lines L1 to L3600 intersects the structures included in the second structure group at a plurality of sites, and at least two sites selected from the plurality of sites have intersection angles different from each other.

2. The electrophotographic photosensitive member according to claim 1, wherein variation in power value $F_1$ in an entire range of $\theta_1$ is 10% or less, and variation in power value $F_2$ in an entire range of $\theta_2$ is 10% or less when in an arbitrary square region 500 μm on a side of the outer surface, a two-dimensional power spectrum obtained by subjecting height information on the structures included in the first structure group to frequency analysis is represented by $F_1(rp_1, \theta_1)$, and a two-dimensional power spectrum is obtained by subjecting height information on the structures included in the second structure group to frequency analysis is represented by $F_2(rp_2, \theta_2)$ where $rp_1$ and $rp_2$ each represent a frequency component, and $\theta_1$ and $\theta_2$ each represent an angle component.

3. The electrophotographic photosensitive member according to claim 1, wherein the structures included in the first structure group and the structures included in the second structure group each have a branch.

4. The electrophotographic photosensitive member according to claim 1, wherein the outer surface comprises a surface of a protective layer arranged directly above the photosensitive layer.

5. A process cartridge, comprising:

an electrophotographic photosensitive member; and at least one unit selected from the group consisting of a charging unit, a developing unit and a cleaning unit, the process cartridge integrally supporting the electrophotographic photosensitive member and the at least one unit, and being removably mounted onto a main body of an electrophotographic image forming apparatus, the electrophotographic photosensitive member having drum shape and being an electrophotographic photosensitive member comprising a support and a photosensitive layer on the support, an outer surface of the electrophotographic photosensitive member comprising a first structure group and a second structure group comprising structures having different appearance periods, an appearance period of the first structure group being smaller than an appearance period of the second structure group, and a height of the first structure group being lower than a height of the second structure group, wherein the structures included in the first structure group and the structures included in the second structure group are such that when a square observation region 100 μm on a side is placed at an arbitrary position on the outer surface, a line passing a central point of the observation region and parallel to a peripheral direction of the electrophotographic photosensitive member is defined as a first reference line L1, with 3,599 reference lines obtained by rotating the first reference line L1 about the central point every 0.1° defined as reference lines L2 to L3600, respectively, each of L1 to L3600 intersects the structures included in the first structure group at a plurality of sites, at least two sites selected from the plurality of sites have intersection angles different from each other, each of the reference lines L1 to L3600 intersects the structures included in the second structure group at a plurality of sites, and at least two sites selected from the plurality of sites have intersection angles different from each other.

6. An electrophotographic image forming apparatus, comprising:

an electrophotographic photosensitive member; and at least one unit selected from the group consisting of a charging unit, an exposing unit, a developing unit and a transferring unit, the electrophotographic photosensitive member having drum shape and being an electrophotographic photosensitive member comprising a support and a photosensitive layer on the support, an outer surface of the electrophotographic photosensitive member comprising a first structure group and a second structure group comprising structures having different appearance periods, an appearance period of the first structure group being smaller than an appearance period of the second structure group, and a height of the first structure group being lower than a height of the second structure group, wherein the structures included in the first structure group and the structures included in the second structure group are such that when a square observation region 100 μm on a side is placed at an arbitrary position on the outer surface, a line passing a central point of the observation region and parallel to a peripheral direction of the electrophotographic photosensitive member is defined as a first reference line L1, and 3,599 reference lines obtained by rotating the first reference line L1 about the central point every 0.1° are respectively defined as reference lines L2 to L3600, each of L1 to L3600 intersects the structures included in the first structure group at a plurality of sites, at least two sites selected from the plurality of sites have intersection angles different from each other, each of the reference lines L1 to L3600 intersects the structures included in the second structure group at a plurality of sites, and at least two sites selected from the plurality of sites have intersection angles different from each other.

7. An electrophotographic photosensitive member having drum shape, the electrophotographic photosensitive member comprising:

a support; and a photosensitive layer on the support, an outer surface of the electrophotographic photosensitive member comprises a first structure group and a second structure group comprising structures having different appearance periods, an appearance period of the first structure group being smaller than an appearance period of the second structure group, and a height of the first structure group being lower than a height of the second structure group, wherein variation in power value $F_1$ in an entire range of $\theta_1$ is 10% or less, and variation in power value $F_2$ in an entire range of $\theta_2$ is 10% or less when, in an arbitrary square region 500 μm on a side of the outer surface, a two-dimensional power spectrum obtained by subjecting height information on the structures included in the first structure group to frequency analysis is represented by $F_1(rp_1, \theta_1)$, and a two-dimensional power spectrum obtained by subjecting height information on the structures included in the second structure group to frequency analysis is represented by $F_2(rp_2, \theta_2)$ where $rp_1$ and $rp_2$ each represent a frequency component, and $\theta_1$ and $\theta_2$ each represent an angle component.

* * * * *